US011231053B2

(12) United States Patent
Eriksson et al.

(10) Patent No.: US 11,231,053 B2
(45) Date of Patent: Jan. 25, 2022

(54) HYDRAULIC VALVE ARRANGEMENT

(71) Applicant: Parker Hannifin EMEA S.à.r.l., Etoy (CH)

(72) Inventors: Björn Eriksson, Johanneshov (SE); Martin Ekstrand, Ulricehamn (SE)

(73) Assignee: Parker Hannifin EMEA S.à.r.l., Etoy (CH)

( * ) Notice: Subject to any disclaimer, the term of this patent is extended or adjusted under 35 U.S.C. 154(b) by 0 days.

(21) Appl. No.: 16/973,083

(22) PCT Filed: Jun. 11, 2019

(86) PCT No.: PCT/EP2019/065218

§ 371 (c)(1),
(2) Date: Dec. 8, 2020

(87) PCT Pub. No.: WO2019/238682

PCT Pub. Date: Dec. 19, 2019

(65) Prior Publication Data

US 2021/0254637 A1 Aug. 19, 2021

(30) Foreign Application Priority Data

Jun. 13, 2018 (DK) ..... PA201870387

(51) Int. Cl.
*F15B 13/04* (2006.01)
*F15B 13/043* (2006.01)
*F15B 13/08* (2006.01)

(52) U.S. Cl.
CPC ..... *F15B 13/0402* (2013.01); *F15B 13/0417* (2013.01); *F15B 13/0435* (2013.01);
(Continued)

(58) Field of Classification Search
CPC ..... F15B 2211/455; F15B 2211/26
See application file for complete search history.

(56) References Cited

U.S. PATENT DOCUMENTS 4,665,801 A 5/1987 Tadeusz
5,163,692 A 11/1992 Schofield et al.
(Continued)

FOREIGN PATENT DOCUMENTS

GB 2302572 B 1/1997
GB 2536177 9/2016
(Continued)

OTHER PUBLICATIONS

International Search Report and Written Opinion issued by WIPO for International Patent Application No. PCT/EP2019/065218 dated Sep. 26, 2019.
(Continued)

*Primary Examiner* — F Daniel Lopez
(74) *Attorney, Agent, or Firm* — Renner, Otto, Boisselle & Sklar, LLP

(57) ABSTRACT

The present disclosure relates to a hydraulic valve arrangement comprising a first pilot operated proportional directional control valve having a first valve member that is displaceable in a first and a second axial direction for controlling direction of supply and discharge of hydraulic fluid to and from a hydraulic actuator, a first proportional electro-hydraulic control valve for controlling displacement of the first valve member in the first axial direction, a second proportional electro-hydraulic control valve for controlling displacement of the first valve member in the second axial direction, and a second pilot operated proportional control valve having a second valve member configured to be controlled by the first and second proportional electro-hydraulic control valves via a shuttle valve arrangement. Individual meter-in and meter-out control of the hydraulic actuator is providable by having the second pilot operated proportional control valve configured to operate as a meter-in valve of the hydraulic actuator and the first pilot operated
(Continued)

proportional directional control valve configured to operate as a meter-out valve of the hydraulic actuator, or by having the first pilot operated proportional directional control valve configured to operate as a meter-in valve of the hydraulic actuator and the second pilot operated proportional control valve configured to operate as a meter-out valve of the hydraulic actuator. The present disclosure also relates to a vehicle comprising a hydraulic actuator and a hydraulic valve arrangement for controlling the motion of the hydraulic actuator.

18 Claims, 11 Drawing Sheets

(52) U.S. Cl.
CPC . *F15B 13/0839* (2013.01); *F15B 2211/30535* (2013.01); *F15B 2211/3144* (2013.01); *F15B 2211/329* (2013.01); *F15B 2211/455* (2013.01); *F15B 2211/46* (2013.01); *F15B 2211/6054* (2013.01)

(56) References Cited

U.S. PATENT DOCUMENTS

| | | | | |
|---|---|---|---|---|
| 5,220,862 | A | 6/1993 | Schexnayder | |
| 6,186,172 | B1 | 2/2001 | Nobumi | |
| 6,878,320 | B1 | 4/2005 | Alderson et al. | |
| 6,964,468 | B2 | 11/2005 | Kitahara et al. | |
| 7,431,307 | B2 | 10/2008 | Anderson et al. | |
| 9,181,070 | B2 * | 11/2015 | Sugano | F15B 11/0445 |
| 2011/0283693 | A1 | 11/2011 | Ramler et al. | |
| 2014/0130487 | A1 | 5/2014 | Akiyama et al. | |
| 2015/0026020 | A1 | 9/2015 | Ferraz, Jr. et al. | |
| 2017/0253468 | A1 * | 9/2017 | Gebele | F15B 11/044 |
| 2018/0017087 | A1 * | 1/2018 | Nakajima | E02F 9/2228 |
| 2018/0340435 | A1 | 11/2018 | Schlemmer et al. | |
| 2021/0062832 | A1 * | 3/2021 | Bruck | F15B 11/044 |

FOREIGN PATENT DOCUMENTS

| | | |
|---|---|---|
| JP | H09132927 | 5/1997 |
| JP | 2000-009102 | 1/2000 |
| WO | 02/055793 | 7/2002 |
| WO | 2008/055147 | 8/2008 |
| WO | 2012/161628 | 11/2012 |
| WO | 2018/032017 | 2/2018 |

OTHER PUBLICATIONS

Search Report Issued by Danish Patent Office for corresponding Danish Patent Application No. PA201870387 dated Oct. 30, 2018.

Pilot-Operated Directional Control Valves—Getting Started; Hydraforce.com [online]; [retrieved on Oct. 29, 2019 using archive.org dated Feb. 5, 2018]; Retrieved from the Internet <URL: https://web.archive.org/web/20180205181904/https:www.hydraforce.com/Integr8/catalog_PDF/Pilot_Operated_Directional-Controls_TO.pdf>; See especially the schematics on p. 00.04.00, 00.04.01, and 00.04.02.

* cited by examiner

HYDRAULIC VALVE ARRANGEMENT

This application is a national phase of International Application No. PCT/EP2019/065218 filed Jun. 11, 2019, which claims the benefit of DK Application No. PA201870387 filed Jun. 13, 2018, both of which are hereby incorporated herein by reference in their entireties.

TECHNICAL FIELD

The disclosure relates to a hydraulic valve arrangement, in particular for a mobile application, such as a working vehicle, forest vehicle, or the like. The disclosure also relates to a vehicle comprising a hydraulic actuator and a hydraulic valve arrangement for controlling the motion of the hydraulic actuator.

Although the disclosure will be described primarily in relation to a working vehicle, such as an excavator, the disclosure is not restricted to this particular vehicle, but may as well be installed in other type of vehicles such as wheel loaders, dumpers, trucks, forklifts or the like, or stationary equipment, such as cranes, hydraulic press equipment, or the like.

BACKGROUND ART

Hydraulic systems are frequently used for powering construction machines, such an excavator, which has a boom assembly comprising a boom, an arm and a bucket pivotally coupled to each other. A hydraulic cylinder assembly is used control and operate the boom assembly, wherein the hydraulic cylinder assembly comprises a plurality of hydraulic cylinders, each having a piston therein which defines two chambers in the cylinder.

During powered extension and retraction of a hydraulic cylinder, pressurized fluid from a pump is usually applied by a valve assembly to one cylinder chamber and all the fluid exhausting from the other cylinder chamber flows through the valve assembly into a return conduit that leads to the system tank. Under some conditions, an external load or other force acting on the machine enables extension or retraction of the cylinder assembly without significant fluid pressure from the pump. This is often referred to as an overrunning load. In an excavator for example, when the bucket is filled with heavy material, the boom can be lowered by the force of gravity alone. Hence, a valve arrangement for controlling a hydraulic actuator must be configured to handle various different operating circumstance.

In the field of fluid hydraulic systems, there is a continuous demand to provide more energy-efficient equipment while keeping equipment cost low. One approach for obtaining more energy-efficient fluid hydraulic control of a hydraulic actuator is to provide the hydraulic valve arrangement controlling the hydraulic actuator with individual meter-in and meter-out control of the flow of hydraulic fluid to and from the hydraulic actuator. Thereby, more freedom in terms of valve setting for controlling the meter-in flow and meter-out flow is possible, such that improved and more energy efficient fluid control and reduced risk for cavitation can be accomplished for each specific operating condition of the hydraulic actuator, such as for example overrunning load condition or power output condition, e.g. powered extension and retraction of a hydraulic cylinder.

One known solution for providing individual meter-in and meter-out control of an hydraulic actuator is to provide four individual control valves, as shown for example in WO 2012/161628 A1.

However, despite the activities in the field, there is still room for improvement of hydraulic valve arrangements to provide more energy-efficient equipment while keeping equipment cost low.

SUMMARY OF THE DISCLOSURE

A general object of the present disclosure is to provide a hydraulic valve arrangement that enables development of more energy-efficient hydraulic systems while keeping equipment cost low.

This and other objects, which will become apparent in the following, are accomplished by a hydraulic valve arrangement as defined in the accompanying independent claim(s).

According to a first aspect of the present disclosure, there is provided a hydraulic valve arrangement comprising: a first pilot operated proportional directional control valve having a first valve member that is displaceable in a first and a second axial direction for controlling direction of supply and discharge of hydraulic fluid to and from a hydraulic actuator, a first proportional electro-hydraulic control valve for controlling displacement of the first valve member in the first axial direction, a second proportional electro-hydraulic control valve for controlling displacement of the first valve member in the second axial direction, and a second pilot operated proportional control valve having a second valve member configured to be controlled by the first and second proportional electro-hydraulic control valves via a shuttle valve arrangement. Individual meter-in and meter-out control of the hydraulic actuator is providable by having the second pilot operated proportional control valve configured to operate as a meter-in valve of the hydraulic actuator and the first pilot operated proportional directional control valve configured to operate as a meter-out valve of the hydraulic actuator, or by having the first pilot operated proportional directional control valve configured to operate as a meter-in valve of the hydraulic actuator and the second pilot operated proportional control valve configured to operate as a meter-out valve of the hydraulic actuator.

In this way, it becomes possible to accomplish Individual meter-in and meter-out control of the hydraulic actuator using only two valve members controlled by only two electro-hydraulic control valves, thereby providing a very cost-effective and robust solution. The solution is cost-effective and robust for several reasons: the hydraulic valve arrangement requires few hydraulic components, thereby making the valve arrangement generally less costly and less complex.

Moreover, the valve arrangement according to the disclosure with two valve members controlled by two electro-hydraulic control valves is very similar to the design of a conventional valve section with integral directional control valve and compensator valve unit. Hence, hydraulic valve arrangement according to the disclosure can be implemented using partly an existing valve section with only relatively small amount of modification.

Further advantages are achieved by implementing one or several of the features of the dependent claims.

In one example embodiment, when the first pilot operated proportional directional control valve operates as a meter-in valve of the hydraulic actuator a hydraulic fluid flow passage, extending between a first or a second actuator port and a fluid outlet port of the first pilot operated proportional directional control valve and controlled by the first valve member, is wide open.

In other words, when the restriction controlling the amount of hydraulic fluid flowing from the pressurized fluid source to the hydraulic actuator is provided by the first valve member in the first pilot operated proportional directional control valve, the restriction controlling the amount of hydraulic fluid flowing from the hydraulic actuator to the tank is not controlled by the first valve member because the outflow passage in the first pilot operated proportional directional control valve is wide open, i.e. without any effective restriction. The effective restriction controlling the amount of hydraulic fluid flowing from the hydraulic actuator to the tank is instead provided by the second valve member in the second pilot operated proportional control valve.

Correspondingly, in one example embodiment when the first pilot operated proportional directional control valve operates as a meter-out valve of the hydraulic actuator a hydraulic fluid flow passage, extending between a fluid inlet port and a first or a second actuator port of the first pilot operated proportional directional control valve and controlled by the first valve member, is wide open.

In other words, when the restriction controlling the amount of hydraulic fluid flowing from the hydraulic actuator to the tank is provided by the first valve member in the first pilot operated proportional directional control valve, the restriction controlling the amount of hydraulic fluid flowing from the pressurized fluid source to the hydraulic actuator is not controlled by the first valve member because the inflow passage in the first pilot operated proportional directional control valve is wide open, i.e. without any effective restriction. The effective restriction controlling the amount of hydraulic fluid flowing from the pressurized fluid source to the hydraulic actuator is instead provided by the second valve member in the second pilot operated proportional control valve.

By having the inflow or outflow passage in the first pilot operated proportional directional control valve wide open it is ensured that the effective flow control by the second pilot operated proportional control valve is not negatively disturbed by the first pilot operated proportional directional control valve, thereby providing a robust and less complex valve arrangement.

In one example embodiment, the shuttle valve arrangement has a first and second inlet port and an outlet port, wherein the outlet port of the first proportional electro-hydraulic control valve is fluidly connected to the first inlet port of the shuttle valve arrangement, wherein the outlet port of the second proportional electro-hydraulic control valve is fluidly connected to the second inlet port of the shuttle valve arrangement, and the outlet port of the shuttle valve arrangement is fluidly connected to the pilot pressure port of the second pilot operated proportional control valve. This shuttle valve arrangement enables the first and second proportional electro-hydraulic control valves, which are configured to control the first pilot operated proportional directional control valve, to control also the second pilot operated proportional control valve. Thereby, fewer relatively complex and costly electro-hydraulic control valves are required, thereby providing a more cost-effective and less complex valve arrangement.

In one example embodiment, a flow control position of the second valve member is controlled by the control valve, out of the first and second proportional electro-hydraulic control valves, which outputs the highest pilot pressure to the shuttle valve arrangement, and a flow control position of the first valve member is controlled by the combined pilot pressure from both the first and second proportional electro-hydraulic control valves acting on opposite ends of the first valve member, such that a ratio between the meter-in and the meter-out opening area is independent from geometry of the first valve member.

In other words, due to the shuttle valve, which has two inlet ports and an outlet port and which automatically connects the inlet port with the higher pressure with the outlet port and closes the other inlet port, the flow control position of the second valve member is controlled by the first proportional electro-hydraulic control valve if the first proportional electro-hydraulic control valve outputs a higher pilot pressure to the shuttle valve arrangement than the second proportional electro-hydraulic control valve. Correspondingly, for the same reason, the flow control position of the second valve member is controlled by the second proportional electro-hydraulic control valve if the second proportional electro-hydraulic control valve outputs a higher pilot pressure to the shuttle valve arrangement than the first proportional electro-hydraulic control valve.

On the other hand, the flow control position of the first valve member depends on the combined, i.e. sum of the pilot pressure from both the first and second proportional electro-hydraulic control valves, because pilot pressure from first proportional electro-hydraulic control valves exerts a pushing force on the first valve member in a first axial direction and pilot pressure from second proportional electro-hydraulic control valves exerts a pushing force on the first valve member in a second axial direction, which is opposite to the first axial direction. Hence, equal pilot pressure from both the first and second proportional electro-hydraulic control valves cancels each other out, and the first valve member will remain in or enter the neutral position. Thereby, fewer relatively complex and costly electro-hydraulic control valves are required, thereby providing a more cost-effective and less complex valve arrangement.

In one example embodiment, as a consequence of the operation of the shuttle valve, which automatically connects the inlet port with the higher pressure with the outlet port and closes the other inlet port, only one of the first and second proportional electro-hydraulic control valve can exert a displacement force on both the first and second valve members at a time. For example, if the first proportional electro-hydraulic control valve outputs a higher pilot pressure than the second proportional electro-hydraulic control valve, only the first proportional electro-hydraulic exerts a displacement force on both the first and second valve members, and oppositely.

In one example embodiment, the hydraulic valve arrangement further comprises an electronic controller for providing electrical control signals to the first and second proportional electro-hydraulic control valves, wherein the electronic controller is configured to provide simultaneous output of control signals to both the first and second proportional electro-hydraulic control valves for enabling individual simultaneous meter-in and meter-out control of the supply and discharge of hydraulic fluid to and from a hydraulic actuator.

As discussed above, due to the operation of the shuttle valve, which automatically connects the inlet port with the higher pressure with the outlet port and closes the other inlet port, only one of the first and second proportional electro-hydraulic control valve can exert a displacement force on both the first and second valve members at a time. Hence, the proportional electro-hydraulic control valve outputting the highest pilot pressure alone controls the position of the second valve member.

However, the proportional electro-hydraulic control valve outputting the highest pilot pressure alone also exerts a displacement force on the first valve member. If the resulting displacement of the first valve member does not correspond to a desired position the other proportional electro-hydraulic control valve, i.e. the proportional electro-hydraulic control valve not outputting the highest pilot pressure, can be used simultaneously for exerting a counter pressure on the first valve member to adjust its position to the desired position.

Having the electronic controller configured to provide simultaneous output of control signals to both the first and second proportional electro-hydraulic control valves enables a cost-effective individual simultaneous meter-in and meter-out control of the hydraulic valve arrangement.

In one example embodiment, the first pilot operated proportional directional control valve has an inlet port for receiving pressurized hydraulic fluid, a first and a second actuator port for supply and discharge of hydraulic fluid to and from the hydraulic actuator, an outlet port for discharging hydraulic fluid to a tank, a first and a second pilot pressure port, and wherein the first valve member is displaceable from a neutral position in the first and a second axial direction by means of pilot pressure acting on the first valve member. In other words, the first pilot operated proportional directional control valve may for example be a 4/3 control valve, or a 5/3 control valve if a load sensing port is included.

In one example embodiment, the first proportional electro-hydraulic control valve has an outlet port fluidly connected to the first pilot pressure port of the first pilot operated proportional directional control valve for controlling displacement of the first valve member in the first axial direction, and wherein the second proportional electro-hydraulic control valve has an outlet port fluidly connected to the second pilot pressure port the first pilot operated proportional directional control valve for controlling displacement of the first valve member in the second axial direction.

In other words, hydraulic pilot control is used for controlling the position of the first valve member. This has the advantage that the pilot pressure supplied by the first and second proportional electro-hydraulic control valves can be used for controlling the position of also the second valve member, thereby enabling use of less valve parts and more cost-effective overall valve arrangement.

In one example embodiment, displacement of the first valve member in the first axial direction opens a first hydraulic fluid passage between the fluid inlet port and the first actuator port and a second hydraulic fluid passage between the second actuator port and the outlet port, and wherein displacement of the first valve member in the second axial direction opens a third hydraulic fluid passage between the fluid inlet port and the second actuator port and a fourth hydraulic fluid passage between the first actuator port and the fluid outlet port.

In one example embodiment, the second pilot operated proportional control valve has an inlet port, an outlet port and a pilot pressure port, wherein the second valve member is arranged to control the flow of hydraulic fluid through the second pilot operated control valve. In other words, the second pilot operated proportional control valve may for example be a 2/2 control valve.

The inlet port of the second pilot operated proportional control valve is fluidly connected, directly or indirectly, to a source of pressurized hydraulic fluid, and the outlet port of the second pilot operated proportional control valve is fluidly connected, directly or indirectly, to the inlet port of the first pilot operated proportional directional control valve. Alternatively, the inlet port of the second pilot operated proportional control valve is fluidly connected, directly or indirectly, to a to the outlet port of the first pilot operated proportional directional control valve, and the outlet port of the second pilot operated proportional control valve is fluidly connected, directly or indirectly, to the tank. The first pilot operated proportional directional control valve and the second pilot operated proportional control valve are thus connected in series in terms of hydraulic fluid flow to and from the hydraulic actuator.

In one example embodiment, a pressure compensating valve is provided in the hydraulic fluid supply line that fluidly connects a source of pressurized hydraulic fluid with an inlet port of the first proportional electro-hydraulic control valve. The pressure compensating valve ensures that the output flow to the hydraulic actuator is constant regardless of any changes in the load pressure.

In one example embodiment, when the second pilot operated proportional control valve configured to operate as a meter-in valve of the hydraulic actuator, the pressure compensating valve is provided either upstream or downstream of the second pilot operated proportional control valve.

In one example embodiment, both the first pilot operated proportional directional control valve and the second pilot operated proportional control valve are provided in a single valve section, which comprises a chassis made in one piece and is configured to be stacked and clamped together with other valve sections for forming a complete valve unit. Providing valve arrangements as valve sections has many advantages, such as sharing of fluid connections to a pressurized fluid source and the tank, sharing mounting arrangements of the valves to a fixed structure, and a very compact overall design.

In one example embodiment, the single valve section comprises the first and second valve members, the first and second pilot pressure ports and a pilot pressure port of the second pilot operated proportional control valve. In other words, the single valve section comprises two valve spools and three pilot pressure ports, thereby providing a compact and robust valve arrangement.

In yet a further alternative configuration the single valve section also includes the shuttle valve arrangement, such that the single valve section comprises only two pilot pressure ports.

In one example embodiment, the first and second valve members are spool valves, each mounted in an individual bore of the single valve section, thereby providing an even more compact valve arrangement.

In one example embodiment, the single valve section further comprises a pressure compensating valve. Further integration of valve members into the single valve section improves the overall compactness and robustness of the valve arrangement. With this design, the single valve section comprises three valve spools and three pilot pressure ports, and when also including the shuttle valve arrangement the single valve section comprises four valves and only two pilot pressure ports.

In one example embodiment, the pressure compensating valve is mounted within the second valve member. This further improves the compactness of the overall valve arrangement.

In one example embodiment, the single valve section is conventional valve section having a main directional valve spool bore and a compensator valve spool bore, wherein the first valve member is mounted in the main directional valve spool bore and the second valve member is mounted in the compensator valve spool bore. Thereby, the valve section according to the disclosure can be accomplished with very little additional effort, and re-use of the valve section housing enables less different parts, and thereby reduced cost.

The disclosure also concerns a vehicle comprising a hydraulic actuator and a hydraulic valve arrangement for controlling the motion of the hydraulic actuator, as described above.

Further features of, and advantages with, the present disclosure will become apparent when studying the appended claims and the following description. The skilled person realize that different features of the present disclosure may be combined to create embodiments other than those described in the following, without departing from the scope of the present disclosure.

BRIEF DESCRIPTION OF THE DRAWINGS

The various example embodiments of the disclosure, including its particular features and example advantages, will be readily understood from the following illustrative and non-limiting detailed description and the accompanying drawings, in which.

DETAILED DESCRIPTION OF EXAMPLE EMBODIMENTS OF THE DISCLOSURE

Figure 1:
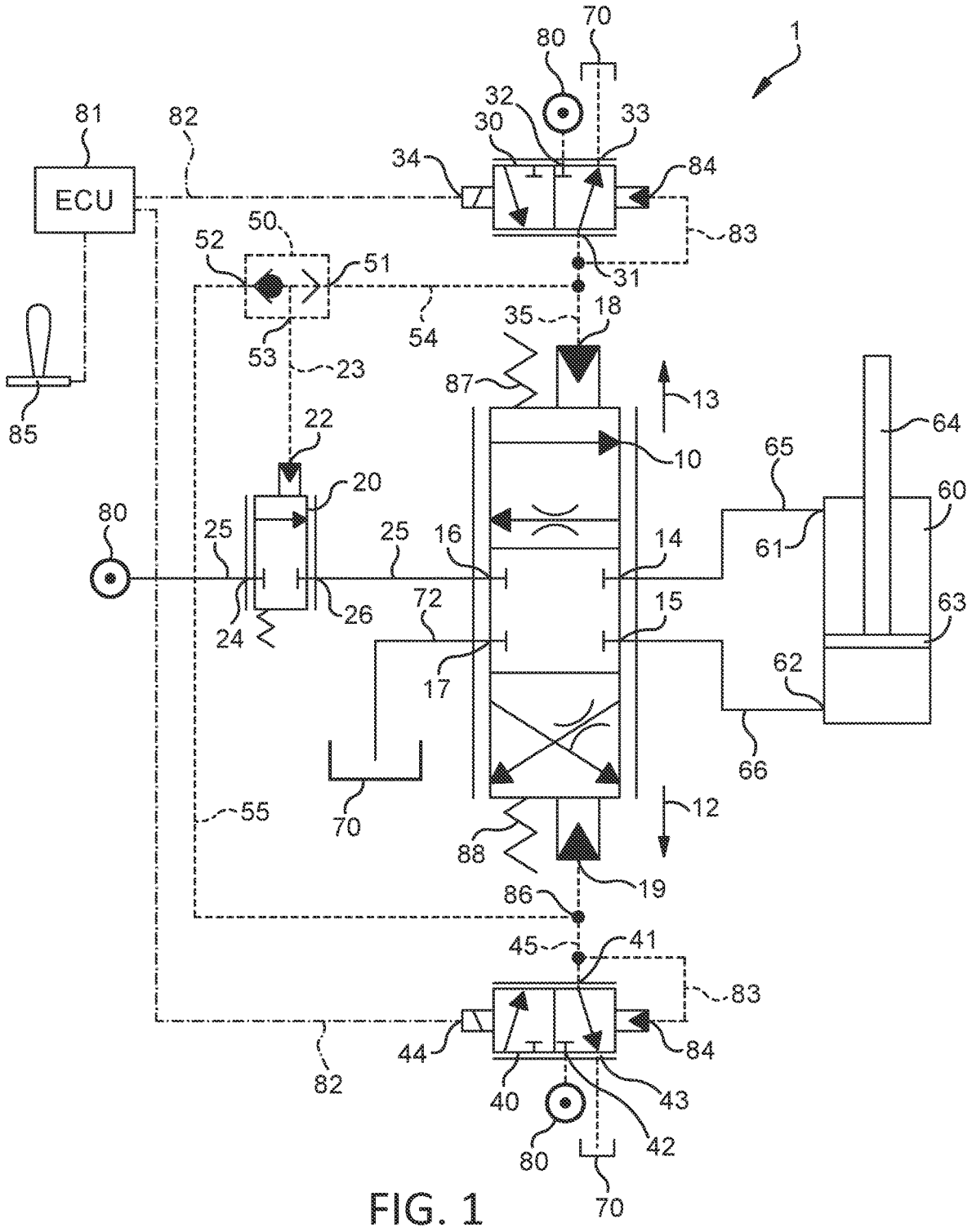
FIG. 1 shows a first example embodiment of the hydraulic valve arrangement.

The present disclosure will now be described more fully hereinafter with reference to the accompanying drawings, in which exemplary embodiments of the disclosure are shown. The disclosure may, however, be embodied in many different forms and should not be construed as limited to the embodiments set forth herein; rather, these embodiments are provided for thoroughness and completeness. Like reference characters refer to like elements throughout the description. The drawings are not necessarily to scale and certain features may be exaggerated in order to better illustrate and explain the exemplary embodiments of the present disclosure.

Referring now to FIG. 1, there is depicted a hydraulic valve arrangement 1 comprising a first pilot operated proportional directional control valve 10 having a first valve member (not showed) that is displaceable in a first and a second axial direction 12, 13 for controlling direction of supply and discharge of hydraulic fluid to and from a hydraulic actuator 60.

In FIG. 1, a first actuator port 14 of the first pilot operated proportional directional control valve 10 is fluidly connected by means of a first actuator fluid line 65 to a first port 61 on the hydraulic actuator 60, and a second actuator port 15 of the first pilot operated proportional directional control valve 10 is fluidly connected by a second actuator fluid line 66 to a second port 62 on the hydraulic actuator 60.

The hydraulic actuator 60 is here depicted as a hydraulic cylinder with a linearly moveable piston 63 and piston rod 64, but the hydraulic valve arrangement according to the disclosure can be equally applicable for other types of actuators, such as for example a hydraulic rotational motor, which is a mechanical actuator that converts hydraulic pressure and flow into torque and angular displacement (rotation).

The first pilot operated proportional directional control valve 10 further has an inlet port 16 for receiving pressurized hydraulic fluid via a fluid inlet line 25 and an outlet port 17 for discharging hydraulic fluid to a tank 70 via a fluid outlet line 72. There may be one single tank 70 or a plurality of interconnected tanks 70. A tank is relatively reservoir for working fluid in a non-pressurized state.

The first pilot operated proportional directional control valve 10 further has a first and a second pilot pressure port 18, 19, and a flow passage between each of the first and a second pilot pressure port 18, 19 to a corresponding pilot control chamber (not showed) for enabling pilot pressure to exert an axial displacement force on the first valve member. The first valve member is thus displaceable from a neutral position in the first and a second axial direction by means of pilot pressure acting on the first valve member, as will be described more in detail below with reference to FIG. 7-10.

The hydraulic valve arrangement further comprises a first proportional electro-hydraulic control valve 30 for controlling displacement of the first valve member in the first axial direction 12, as well as a second proportional electro-hydraulic control valve 40 for controlling displacement of the first valve member in the second axial direction 13. The second axial direction 13 is opposite to the first axial direction 12.

The first proportional electro-hydraulic control valve 30 has an outlet port 31 fluidly connected to the first pilot pressure port 18 of the first pilot operated proportional directional control valve 10 for controlling displacement of the first valve member in the first axial direction 12, and the second proportional electro-hydraulic control valve 40 has an outlet port 41 fluidly connected to the second pilot pressure port 19 the first pilot operated proportional directional control valve 10 for controlling displacement of the first valve member in the second axial direction 13. The first and second proportional electro-hydraulic control valves 30, 40 may thus be referred to as pilot valves.

Each of the first and second proportional electro-hydraulic control valve 30, 40 further has fluid inlet port 32, 42 connected to a pressurized fluid source 80 via a pressure reducing valve (not showed), a discharge port 33, 43 fluidly connected to a tank 70, and an electrical control signal port 34, 44 for receiving electrical control signals from an electronic control unit (ECU) 81, either via an electrical wire 82, or wirelessly.

Each of the first and second proportional electro-hydraulic control valve 30, 40 is a proportional solenoid operated control valve, meaning that the valve member in said control valves 30, 40 is controlled by and electromagnetically inductive coil that is wound around for example a movable steel or iron member referred to as the armature, which is connected to valve member for transferring a mechanical to force to the valve member and thus to move said valve member. Proportional solenoid operated control valves means that output force of the solenoids is proportional to the input current that is applied to the coil current.

In operation, the proportional solenoid of each of the first and second proportional electro-hydraulic control valve 30, 40 opens a passage between the fluid inlet port 32, 42 and the fluid outlet port 31, 41 and supplies pilot pressure to the end of the first valve member via a first and second pilot line 35, 45, respectively. Moreover, the proportional solenoid further adapts the pressure in proportion to the incoming electrical control signal. The first and second proportional electro-hydraulic control valve 30, 40 may thus be deemed representing the interface between the electric and hydraulic control signals.

The first and second proportional electro-hydraulic control valve 30, 40 are configured to generate a certain predetermined output pilot pressure for each given level of the incoming electrical control signal, for enabling a proper control of the first valve member. Consequently, each of the first and second proportional electro-hydraulic control valve 30, 40 includes a pressure reducing functionality for providing the desired output pilot pressure.

The pressure reducing functionality may for example be implemented by means of a feedback line 83 that supplies the outputted pilot pressure back to a pilot pressure port 84 of each proportional electro-hydraulic control valve 30, 40 for exerting a closing force on the valve member thereof.

The first pilot operated proportional directional control valve 10 is arranged such that displacement of the first valve member in the first axial direction 12 opens a first hydraulic fluid passage between the fluid inlet port 16 and the first actuator port 14 and a second hydraulic fluid passage between the second actuator port 15 and the outlet port 17. Correspondingly, displacement of the first valve member in the second axial direction 13 opens a third hydraulic fluid passage between the fluid inlet port 16 and the second actuator port 15 and a fourth hydraulic fluid passage between the first actuator port 14 and the fluid outlet port 17.

The hydraulic valve arrangement further comprises a second pilot operated proportional control valve 20 having a second valve member 21 (not showed) configured to be controlled by the first and second proportional electro-hydraulic control 30, 40 valves via a shuttle valve arrangement 50.

The second pilot operated proportional control valve 20 has an inlet port 24, an outlet port 26 and a pilot pressure port 22, wherein the second valve member (not showed) is arranged to control the flow of hydraulic fluid through the second pilot operated control valve 20.

The inlet port 24 of the second pilot operated proportional control valve 20 is fluidly directly connected to a source 80 of pressurized hydraulic fluid, and the outlet port 26 of the second pilot operated proportional control valve 20 is directly fluidly connected to the inlet port 16 of the first pilot operated proportional directional control valve 10.

The shuttle valve arrangement 50 has a first and second inlet ports 51, 52 and an outlet port 53, wherein the outlet port 31 of the first proportional electro-hydraulic control valve 30 is fluidly connected to the first inlet port 51 of the shuttle valve arrangement 50 via a first shuttle inlet line 54, wherein the outlet port 41 of the second proportional electro-hydraulic control valve 40 is fluidly connected to the second inlet port 52 of the shuttle valve arrangement 50 via a second shuttle inlet line 55, and wherein the outlet port 53 of the shuttle valve arrangement 50 is fluidly connected to a pilot pressure port 22 of the second pilot operated proportional control valve 20 via a third pilot line 23.

A shuttle valve arrangement may be implemented in various ways. For example, a dedicated shuttle valve may be used, or a shuttle valve arrangement comprising two oppositely connected check-valves may be used, or a ⅔ pilot operated directional control valve may be used in which the pilot pressure from the first and second proportional electro-hydraulic control valves 30, 40 is supplied to both the pilot pressure ports of the control valve, as well as to a first and second inlet ports, and an outlet port is connected to the pilot pressure port 22 of the second pilot operated proportional control valve 20.

In operation, the shuttle valve arrangement 50 either:

fluidly connects the outlet port 31 of the first proportional electro-hydraulic control valve 30 with the pilot pressure port 22 of the second pilot operated proportional control valve 20, and fluidly disconnects the outlet port 41 of the second proportional electro-hydraulic control valve 40 from the second pilot operated proportional control valve 20, or fluidly connects the outlet port 41 of the second proportional electro-hydraulic control valve 40 with the pilot pressure port 22 of the second pilot operated proportional control valve 20, and fluidly disconnects the outlet port 31 of the first proportional electro-hydraulic control valve 30 with the pilot pressure port 22 of the second pilot operated proportional control valve 20.

Individual, or sometimes referred to as separate meter-in and meter-out control herein refers to distributed throttle control of meter-in and meter-out flow in and out from a hydraulic actuator. In contrast to a conventional valve arrangement where both the meter-in and meter-out orifices are mechanically coupled due to the use of a single directional spool valve member, individual meter-in and meter-out control enables a higher degree of freedom in control because meter-in and meter-out orifices are not mechanically coupled and can even be controlled individually.

In the hydraulic valve arrangement according to FIG. 1, individual meter-in and meter-out control of the hydraulic actuator 60 is providable by having the second pilot operated proportional control valve 20 configured to operate as a meter-in valve of the hydraulic actuator 60 and the first pilot operated proportional directional control valve 10 configured to operate as a meter-out valve of the hydraulic actuator 60.

In other words, the second pilot operated proportional control valve 20 may be configured to operate as a meter-in valve that controls the flow of pressurized hydraulic fluid being supplied to the hydraulic actuator 60 and the first pilot operated proportional directional control valve 10 may be configured to operate as a meter-out valve that controls the flow of hydraulic fluid being discharged from the hydraulic actuator 60.

For example, during a desired extension phase of piston rod 64 of the hydraulic actuator 60 in FIG. 1, the ECU first activates the solenoid of the second proportional electro-hydraulic control valve 40 with a current proportional to a desired extension rate, which may be determined for example by reading a sensor input from a joystick 85 or other input device. The current in the solenoid generates a magnetic field that pushes the armature, and thus also the valve member in the second proportional electro-hydraulic control valve 40 to open a flow passage between the fluid inlet port 42 and the fluid outlet port 41 and supplies hydraulic pilot pressure via the second pilot line 45 to the second pilot pressure port 19 and corresponding pilot control chamber for exerting a force on the end of the first valve member in the second direction 13.

The meter-in orifice in the third hydraulic fluid passage between the fluid inlet port 16 and the second actuator port 15, which in conventional proportional directional control valves is relatively small and gradually increasing in size with increased axial displacement of the second valve member in the second direction 13 for enabling precise control of the inlet flow rate according to a desired extension speed, is here made very large in a nearly step-wise manner for the purpose of immediately providing a restriction-free third hydraulic fluid passage upon axial displacement of the second valve member in the second direction 13.

In other words, the first pilot operated proportional directional control valve 10 configured to operate a pure meter-in flow router that controls the flow direction of pressurized hydraulic fluid entering at the fluid inlet port 16.

Due to a first branch point 86 hydraulic pilot pressure from the second proportional electro-hydraulic control valve 40 is simultaneously supplied via the second shuttle inlet line 55 to the second inlet port 52 of the shuttle valve arrangement 50. Since the first proportional electro-hydraulic control valve 30 at this time point does not supply any hydraulic pilot pressure the shuttle valve arrangement 50 automatically sets itself in a position in which a flow passage between the second inlet port 52 and the outlet port 53 of the shuttle valve arrangement 50 is opened, while the flow passage between the first inlet port 51 and the outlet port 53 of the shuttle valve arrangement 50 is closed.

Consequently, hydraulic pilot pressure from the second proportional electro-hydraulic control valve 40 is simultaneously supplied to the pilot pressure port 22 of the second pilot operated proportional control valve 20 via the third pilot line 23.

According to the disclosure, the second pilot operated proportional control valve 20 is in this example embodiment arranged to take over the role as meter-in valve. This is the reason why the first pilot operated proportional directional control valve 1 is configured to immediately provide a restriction-free third hydraulic fluid passage upon axial displacement of the second valve member in the second direction 13, i.e. for enabling the second pilot operated proportional control valve 20 to act as meter-in valve without negative interference from any type of flow restriction in the third hydraulic fluid passage. Consequently, the second pilot operated proportional control valve 20 will operate as a meter-in valve that controls the flow of pressurized hydraulic fluid being supplied from the pressurized fluid source 80 to the second port 62 of the hydraulic actuator 60, and the meter-in orifice in the second pilot operated proportional control valve 20 will be proportional to the supplied hydraulic pilot pressure from the second proportional electro-hydraulic control valve 40.

Meanwhile, for accomplishing the desired advantages of individual meter-in and meter-out control, the meter-out orifice in the fourth hydraulic fluid passage between the first actuator port 14 and the fluid outlet port 17 will be controlled gradually increasing the hydraulic pilot pressure supplied from the fluid outlet port 31 of the first proportional electro-hydraulic control valve 30 to the first pilot pressure port 18 for exerting a force on the end of the first valve member in the first direction 12.

Control of the hydraulic pilot pressure supplied from the fluid outlet port 31 of the first proportional electro-hydraulic control valve 30 is provided by having the ECU activating the solenoid of the first proportional electro-hydraulic control valve 30, such that the valve member in the first proportional electro-hydraulic control valve 30 supplies a desired level of hydraulic pilot pressure.

Hydraulic pilot pressure will thus be supplied to both axial ends of the first valve member and resulting flow control position of the first valve member will be determined the combined pilot pressure from both the first and second proportional electro-hydraulic control valves 30, 40 acting on opposite ends of the first valve member.

The spring force exerted on the first valve member by means of first and second axial springs 87, 88, and the specific design of the meter-out orifice in the fourth hydraulic fluid passage, are set for enabling appropriate opening degree of the meter-out orifice in the fourth hydraulic fluid passage upon supply of a lower level of hydraulic pilot pressure supplied from the first proportional electro-hydraulic control valve 30 than the level of hydraulic pilot pressure supplied from the second proportional electro-hydraulic control valve 40.

Moreover, the flow path in the third hydraulic fluid passage is configured to open significantly before opening of the meter-out orifice in the fourth hydraulic fluid passage, such that variations in the axial position of the first valve member during control of the meter-out orifice in the fourth hydraulic fluid passage can be provided with maintained wide open third hydraulic fluid passage.

Thereby, the first pilot operated proportional directional control valve 10 may be configured to operate as a meter-out valve that controls the flow of hydraulic fluid being discharged from the hydraulic actuator 60.

In other words, in this example embodiment which describes the operation of the hydraulic valve arrangement during a desired extension phase of piston rod 64 of the hydraulic actuator 60 in FIG. 1, a flow control position of the second valve member is controlled by the second proportional electro-hydraulic control valve 40 and the flow control position of the first valve member is controlled by the combined pilot pressure from both the first and second proportional electro-hydraulic control valves acting on opposite ends of the first valve member.

As a result, a ratio between the effective meter-in and the meter-out opening area is independent from solely the geometry of the first valve member 11. Instead, since the meter-in opening area is controlled by the position of the second valve member 21 and meter-out opening area is controlled by the position of the first valve member 11, the ratio between the effective meter-in and the meter-out opening area is dependent partly on the flow control position of the second valve member 21 and partly on the flow control position of the first valve member 11.

It is also clear from this example embodiment that the first or the second proportional electro-hydraulic control valve 30, 40, one at a time, is arranged to exert a displacement force on both the first and second valve members, and in the above example the second proportional electro-hydraulic control valve 40 exert a displacement force on both the first and second valve members.

It is further clear that the electronic controller is configured to provide simultaneous output of control signals to both the first and second proportional electro-hydraulic control valves 30, 40 for enabling individual simultaneous meter-in and meter-out control of the supply and discharge of hydraulic fluid to and from a hydraulic actuator 60.

Figure 2:
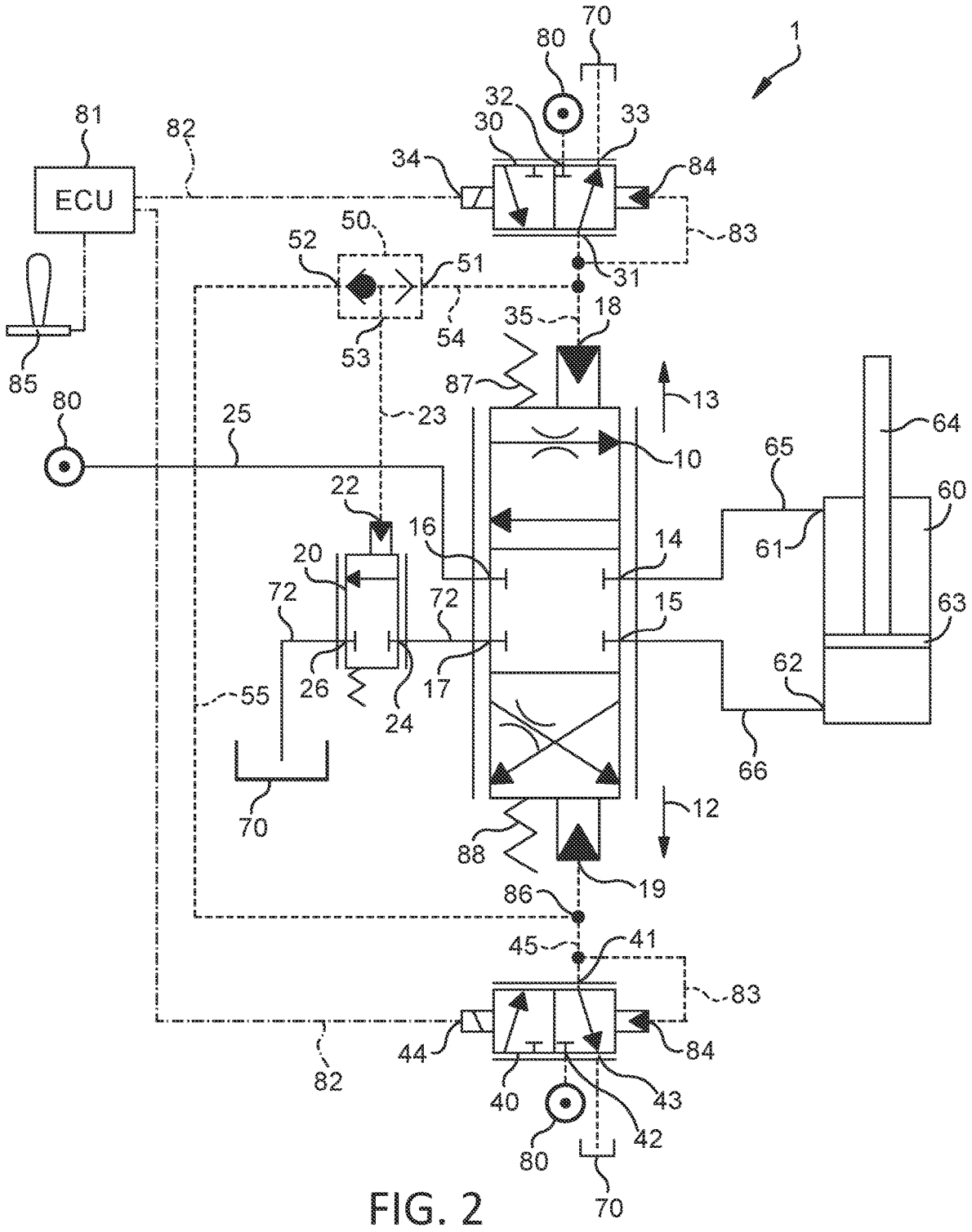
FIG. 2 shows a second example embodiment of the hydraulic valve arrangement.

According to an alternative embodiment, as schematically shown in FIG. 2, the hydraulic valve arrangement provides individual meter-in and meter-out control of the hydraulic actuator 60 by having the first pilot operated proportional directional control valve 10 configured to operate as a meter-in valve of the hydraulic actuator 60 and the second pilot operated proportional control valve 20 configured to operate as a meter-out valve of the hydraulic actuator 60.

In other words, the inlet port 24 of the second pilot operated proportional control valve 20 is fluidly directly connected to the outlet port 17 of the first pilot operated proportional directional control valve 10, and the outlet port 26 of the second pilot operated proportional control valve 20 is fluidly connected to the tank 70.

The functionality of the hydraulic valve arrangement of FIG. 2 is otherwise identical to that described above with reference to FIG. 1. For example, the meter-out orifice in the fourth hydraulic fluid passage between the first actuator port 14 and the fluid outlet port 17 is here made very large in a nearly step-wise manner for the purpose of immediately providing a restriction-free fourth hydraulic fluid passage upon axial displacement of the second valve member in the second direction 13, such that the first pilot operated proportional directional control valve 10 configured to operate a pure meter-out flow router that controls the flow direction of hydraulic fluid entering at the first and second actuator ports 14, 15.

Moreover, the second pilot operated proportional control valve 20 is configured to take over the role as meter-out valve, and the meter-out orifice in the second pilot operated proportional control valve 20 will be proportional to the supplied hydraulic pilot pressure from the second proportional electro-hydraulic control valve 40.

Meanwhile, for accomplishing the desired advantages of individual meter-in and meter-out control, the meter-in orifice in the third hydraulic fluid passage between the fluid inlet port 16 and the second actuator port 15 will be controlled gradually increasing the hydraulic pilot pressure supplied from the fluid outlet port 31 of the first proportional electro-hydraulic control valve 30 to the first pilot pressure port 18 for exerting a force on the end of the first valve member in the first direction 12.

Hydraulic pilot pressure will thus be supplied to both axial ends of the first valve member and resulting flow control position of the first valve member will be determined the combined pilot pressure from both the first and second proportional electro-hydraulic control valves 30, 40 acting on opposite ends of the first valve member.

The control of the meter-in and meter-out orifices may have been described in a sequential manner above but the disclosure is not limited to such sequential control. On the contrary, control signals from the ECU 81 to the first and second proportional electro-hydraulic control valves 30, 40 are typically outputted simultaneously to the first and second proportional electro-hydraulic control valves 30, 40.

Figure 3:
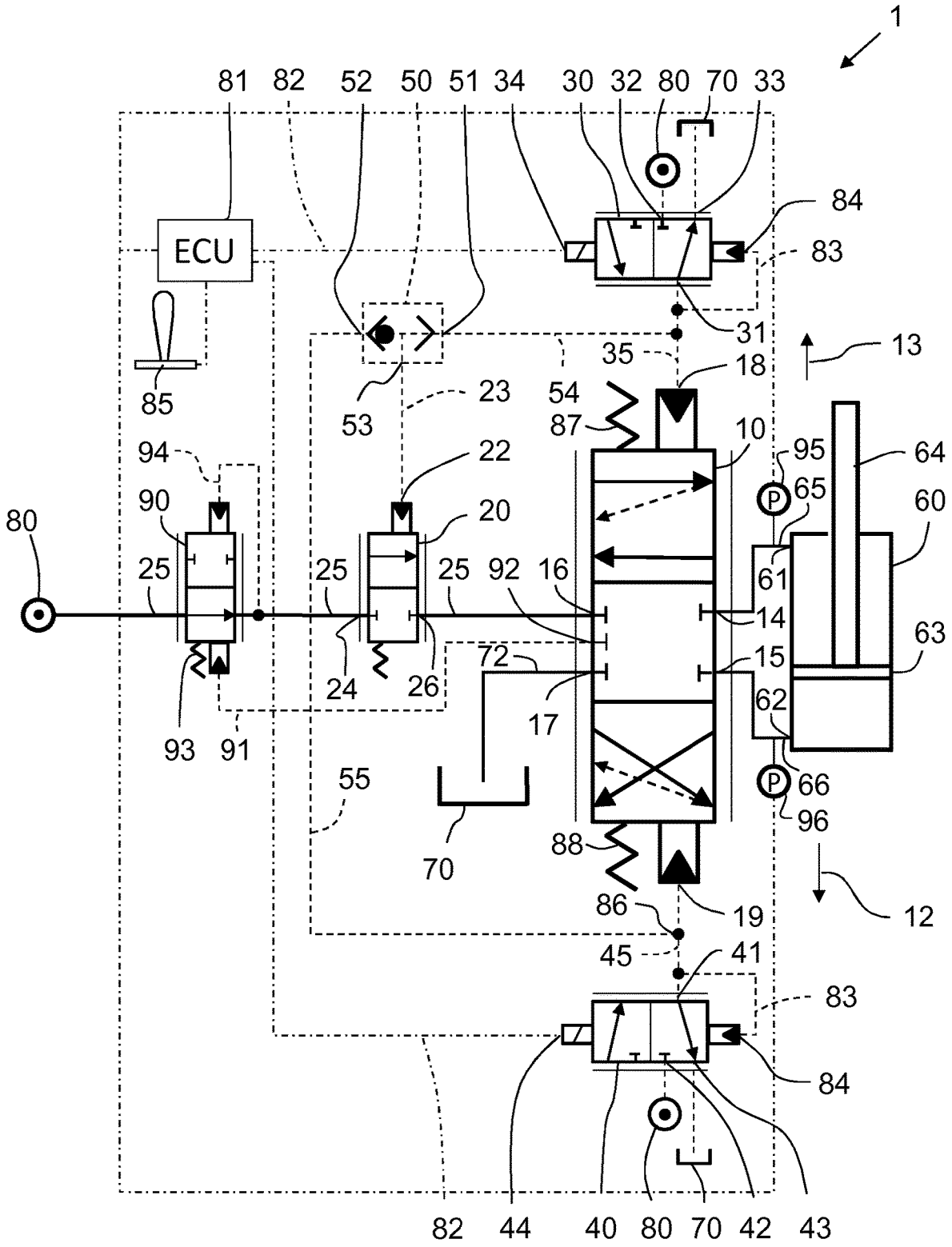
FIG. 3 shows an alternative design of the first example embodiment of the hydraulic valve arrangement.

FIG. 3 schematically shows an alternative example embodiment of the invention similar to the embodiment of FIG. 1, but additionally including a pressure compensating valve 90 provided in the hydraulic fluid supply line 25 that fluidly connects a source 80 of pressurized hydraulic fluid with an inlet port 16 of the first proportional electro-hydraulic control valve 10.

In FIG. 3, the second pilot operated proportional control valve configured to operate as a meter-in valve of the hydraulic actuator 60 and the pressure compensating valve is provided upstream of the second pilot operated proportional control valve 20. In detail, the pressure compensating valve 90 is provided in the hydraulic fluid supply line 25 that fluidly connects a source 80 of pressurized hydraulic fluid with an inlet port 24 of the first proportional electro-hydraulic control valve 20. However, the pressure compensating valve 90 may alternatively be provided downstream of the second pilot operated proportional control valve 20.

The pressure compensating valve 90 serves to block unused pump flow at the inlet, allowing load sensing pumps to destroke, and to provide constant pressure over the first proportional electro-hydraulic control valve 10, such that output flow to the hydraulic actuator 60 is constant regardless of changes in the load of the hydraulic actuator 60.

The pressure compensating valve 90 may for example comprises a spool valve, and load pressure, supplied via load sensing passage 91 connected to load sensing port 92 on the first proportional electro-hydraulic control valve 10, is and a bias spring 93 acts on one side of the compensator spool, while pump pressure, supplied via a pump pressure line 94, acts on the opposite side of the spool.

The ECU 81 may be equipped with software based control program that controls the output signals to the first and second proportional electro-hydraulic control valves 30, 40 based on registered input signals from one or more user input devices and registered input signals indicating current position, speed and/or acceleration of the hydraulic actuator. For example, pressure sensors 95, 96 may be provided for sensing the pressure in the first and second actuator fluid lines 65, 66.

Figure 4:
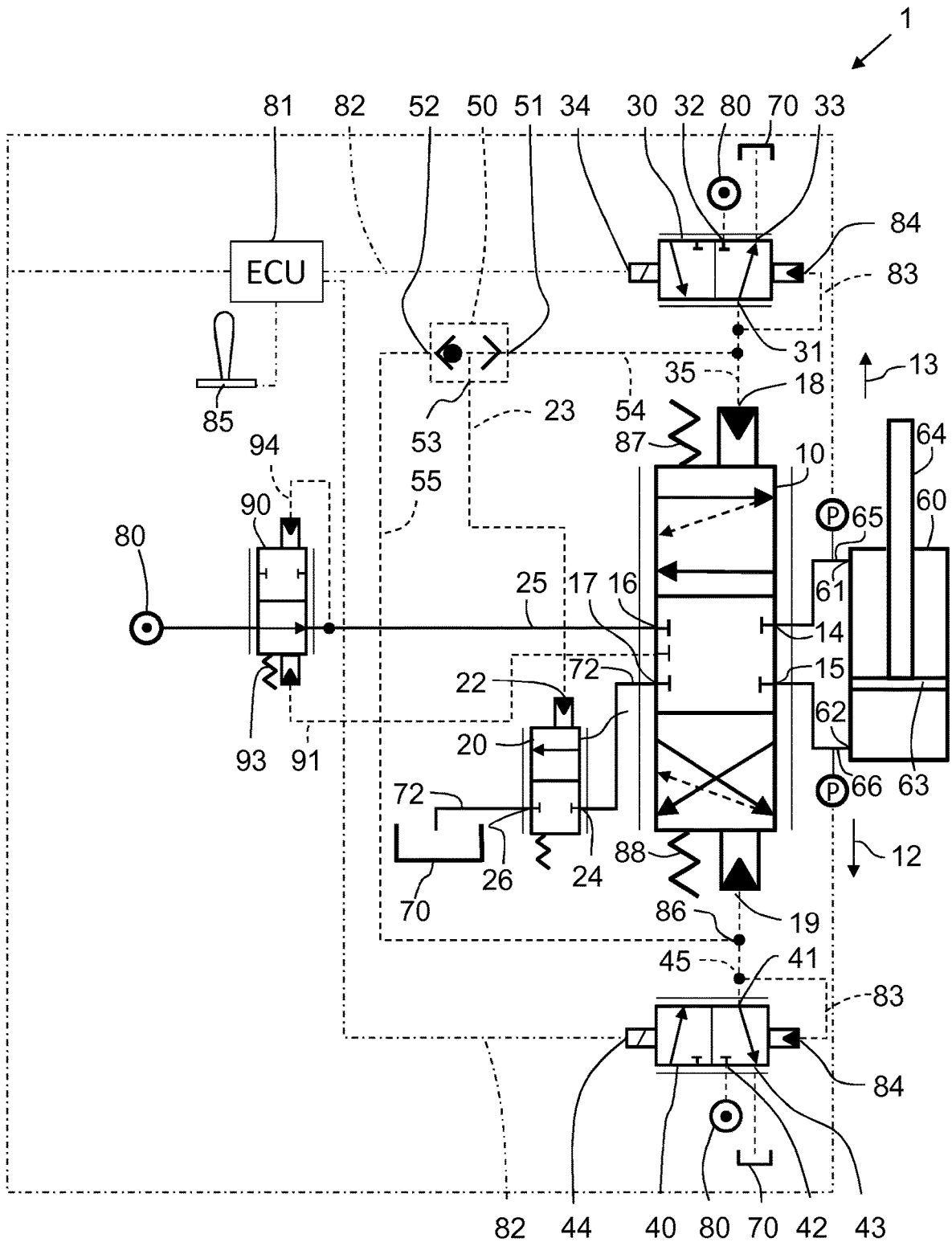
FIG. 4 shows an alternative design of the second example embodiment of the hydraulic valve arrangement.

FIG. 4 schematically shows an alternative example embodiment of the invention similar to the embodiment of FIG. 2, but additionally including a pressure compensating valve 90 provided in the hydraulic fluid supply line 25 that fluidly connects a source 80 of pressurized hydraulic fluid with an inlet port 16 of the first proportional electro-hydraulic control valve 10. As in FIG. 2, the hydraulic valve arrangement provides individual meter-in and meter-out control of the hydraulic actuator 60 by having the first pilot operated proportional directional control valve 10 configured to operate as a meter-in valve of the hydraulic actuator 60 and the second pilot operated proportional control valve 20 configured to operate as a meter-out valve of the hydraulic actuator 60.

Figure 5:
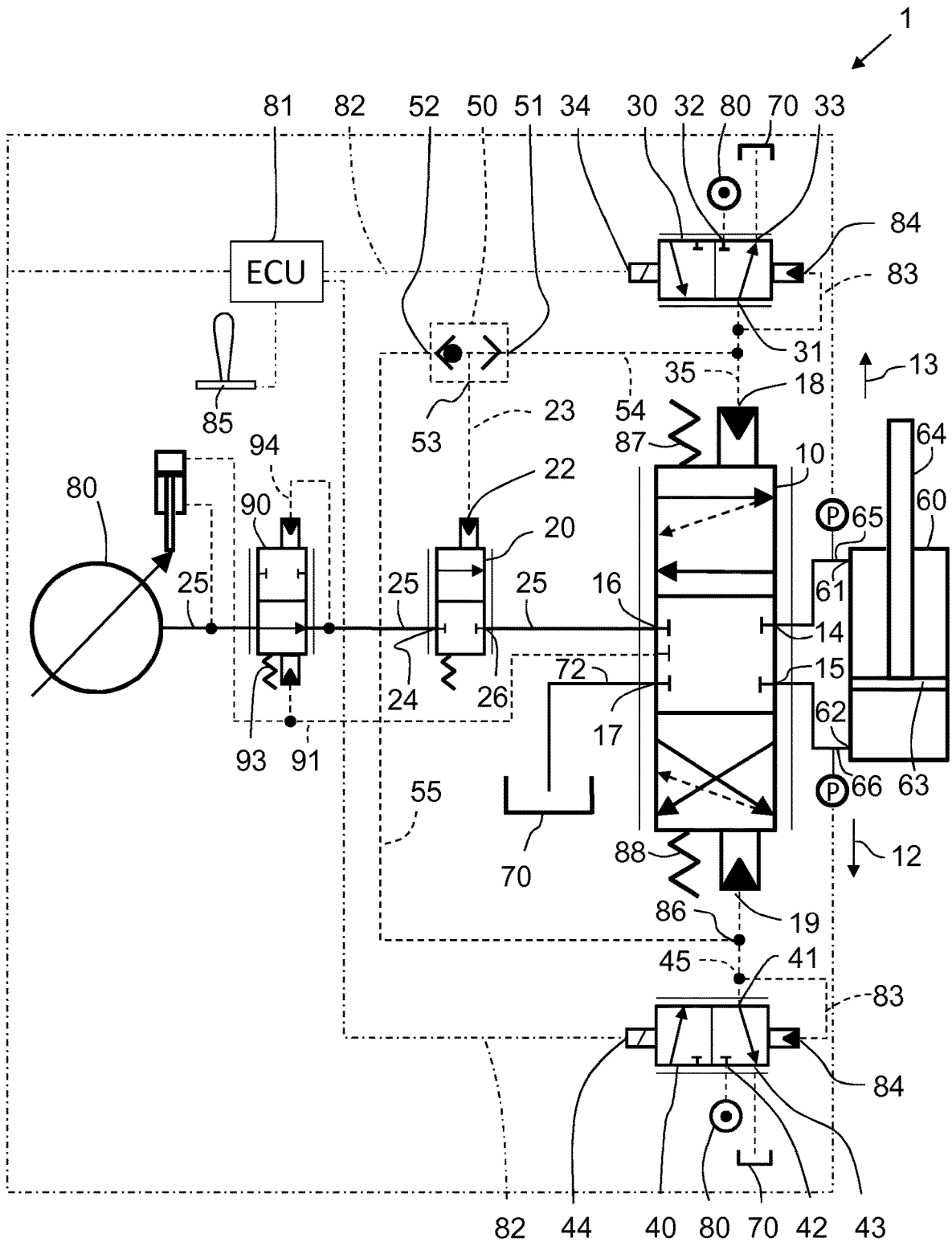
FIG. 5 shows still an alternative design of the first example embodiment of the hydraulic valve arrangement.

FIG. 5 shows an example embodiment of the disclosure that differs from the example embodiment of FIG. 3 only in that the pressurized fluid source 80 has been described more in detail as a variable displacement pump 80 with load sensing detection, which is configured to detect load pressure supplied via load sensing passage 91 and pump output pressure.

The specific design and configuration of the first proportional electro-hydraulic control valve 10 can be varied while keeping the basic underlying solution for providing independent meter-in and meter-out control of the present disclosure. For example, the first proportional electro-hydraulic control valve 10 may include flow regeneration capability.

Figure 6:
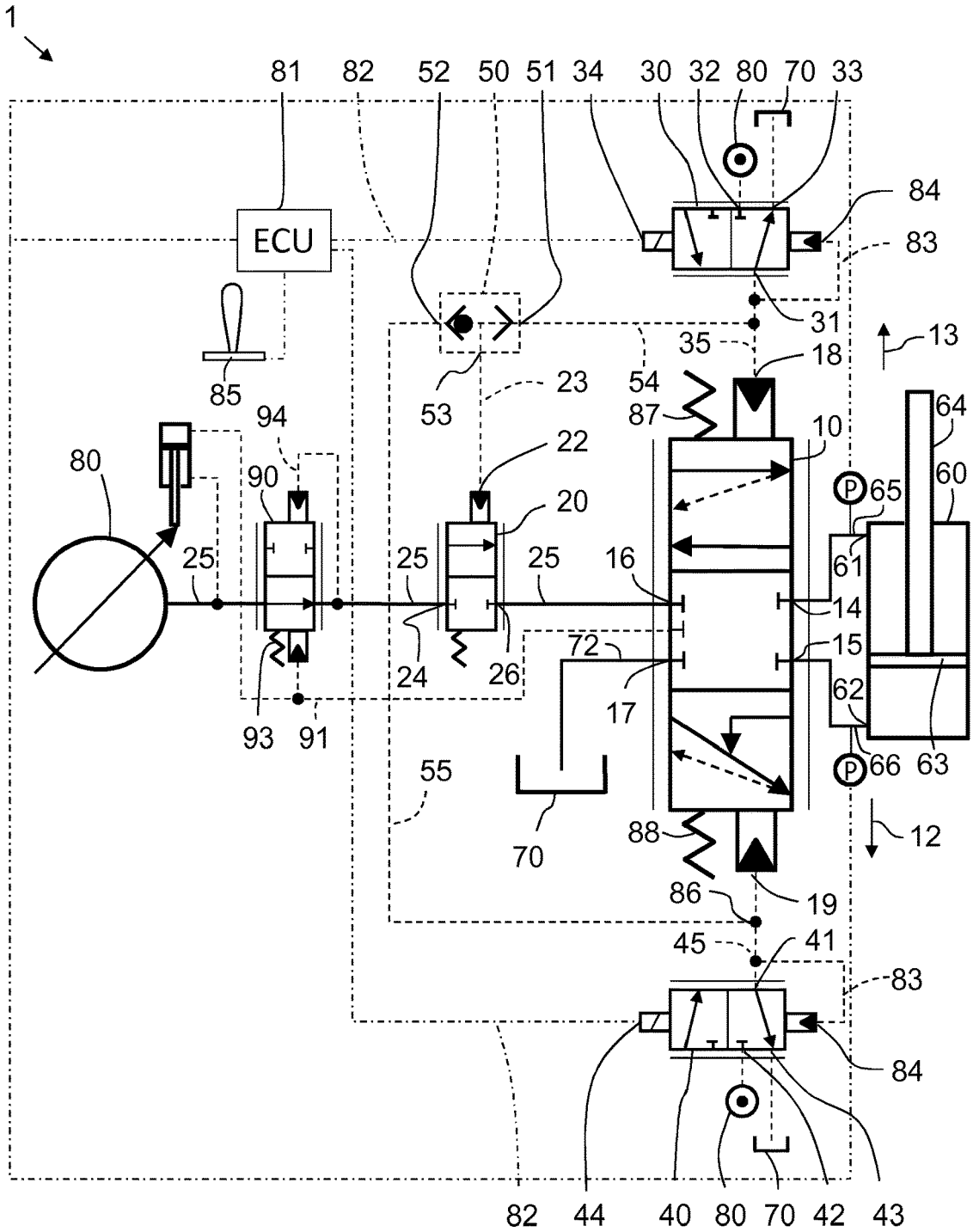
FIG. 6 shows yet a further alternative design of the first example embodiment of the hydraulic valve arrangement.

One example embodiment of a valve arrangement including flow regeneration is illustrated in FIG. 6, wherein upon extension of the piston rod 64, the first proportional electro-hydraulic control valve 10 may be configured to fluidly connect the first actuator port 14 with the second actuator port 15, such that fluid exiting from a rod chamber of the cylinder may flow directly into a head chamber of the hydraulic actuator. Alternatively, such flow regeneration may be provided with an additional external valve connecting the first and second ports 61, 62 of the hydraulic actuator 60.

Figure 7:
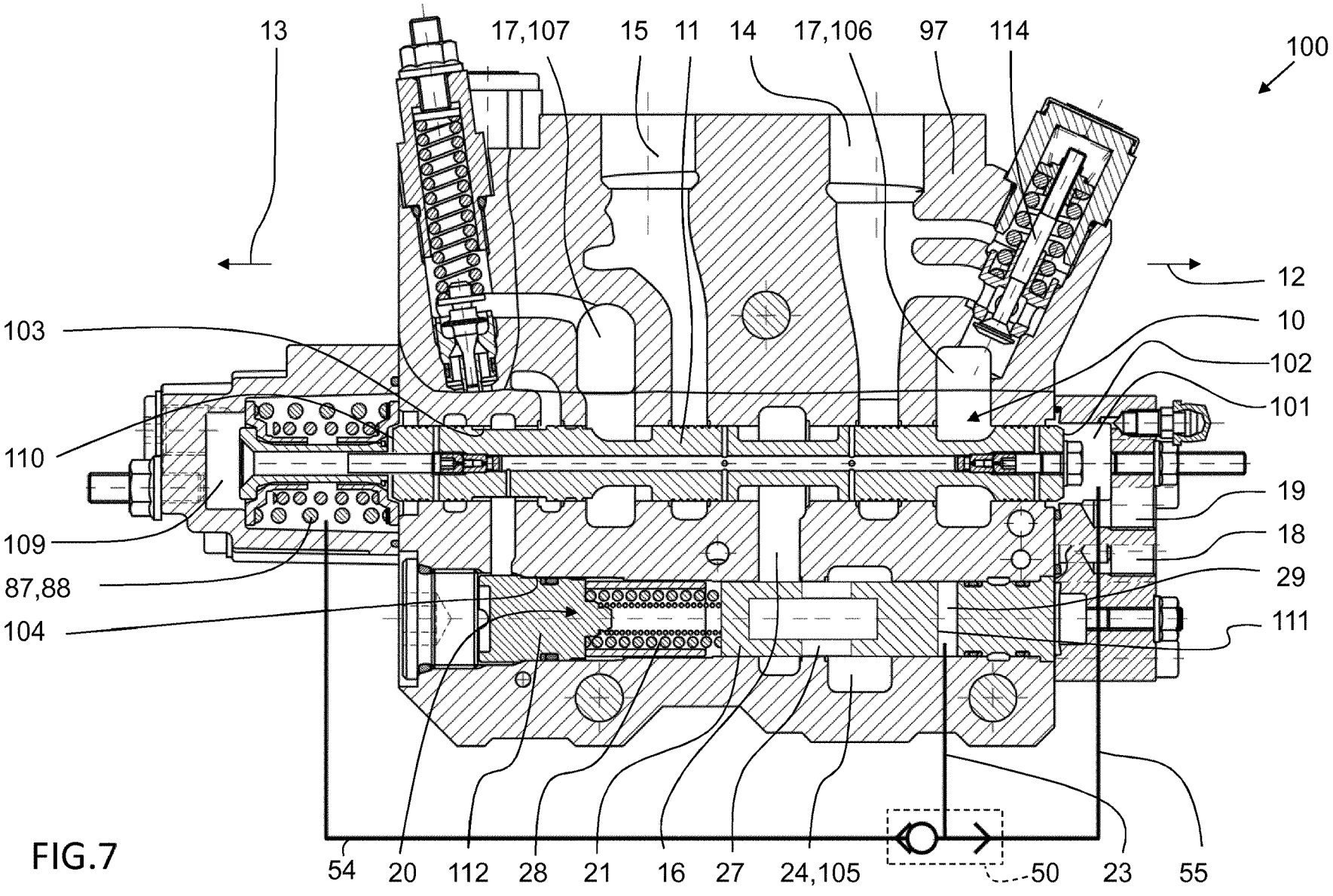
FIG. 7 shows a first example embodiment of a valve section according to the disclosure in a neutral state.

As illustrated in the example embodiment of FIG. 7, the hydraulic valve arrangement according to the disclosure may be at least partly implemented in form of a single valve section. A valve arrangement may for example comprise a plurality of valve sections that are stacked and subsequently clamped together to form a single unit. A valve section thus has two main faces that are configured to face a main face of another valve section, or an endpiece.

Providing the valve arrangement at least partly implemented in a valve section provides various advantages, such as simplified connection to a pressurized fluid and tank because a valve unit with multiple valve sections typically has internal passages for distributing pressurized hydraulic fluid and tank access, such that a valve unit with multiple stacked valve sections typically merely requires one connection to the pressurised fluid source and one connection to the tank.

Hence, in FIG. 7, a first internal passage 105, which is connected to the pressurized fluid source 80, extends completely through the valve section 100 for enabling supply of pressurized hydraulic fluid to the inlet port 24 of the second pilot operated proportional control valve 20 of valve section 100, as well as for supplying pressurized hydraulic fluid to the other individual sections of a valve unit with multiple stacked valve sections.

In addition, a second and a third internal passage 106, 107, each connected to the tank 70, also extends completely through the valve section 100 for enabling simple connected of the fluid outlet port 17 of the first pilot operated proportional directional control valve 10 to the tank 70, as well as enabling simplified and common access to the tank 70 for all other individual sections of a valve unit with multiple stacked valve sections.

A further advantage of the valve section concept is that a valve unit with multiple stacked and clamped valve sections is generally easier to fasten to a support surface due the structural integrity of the valve unit compared with fastening of a plurality of individual valve parts.

FIG. 7 shows an example embodiment of a single valve section 100 comprising both the first pilot operated proportional directional control valve 10 and the second pilot operated proportional control valve 20, wherein the single valve section 100 comprises a chassis made in one piece and is configured to be stacked and clamped together with other valve sections for forming a complete valve unit.

Figure 9:
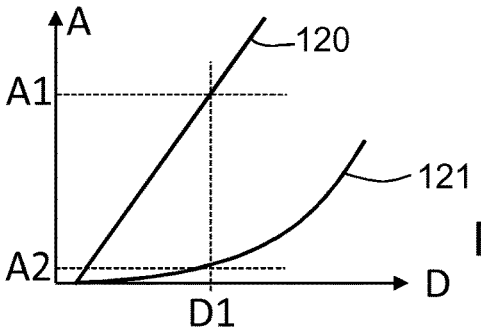
FIG. 9 shows a diagram illustrating an example of an opening characteristic of the first valve member.
Figure 8:
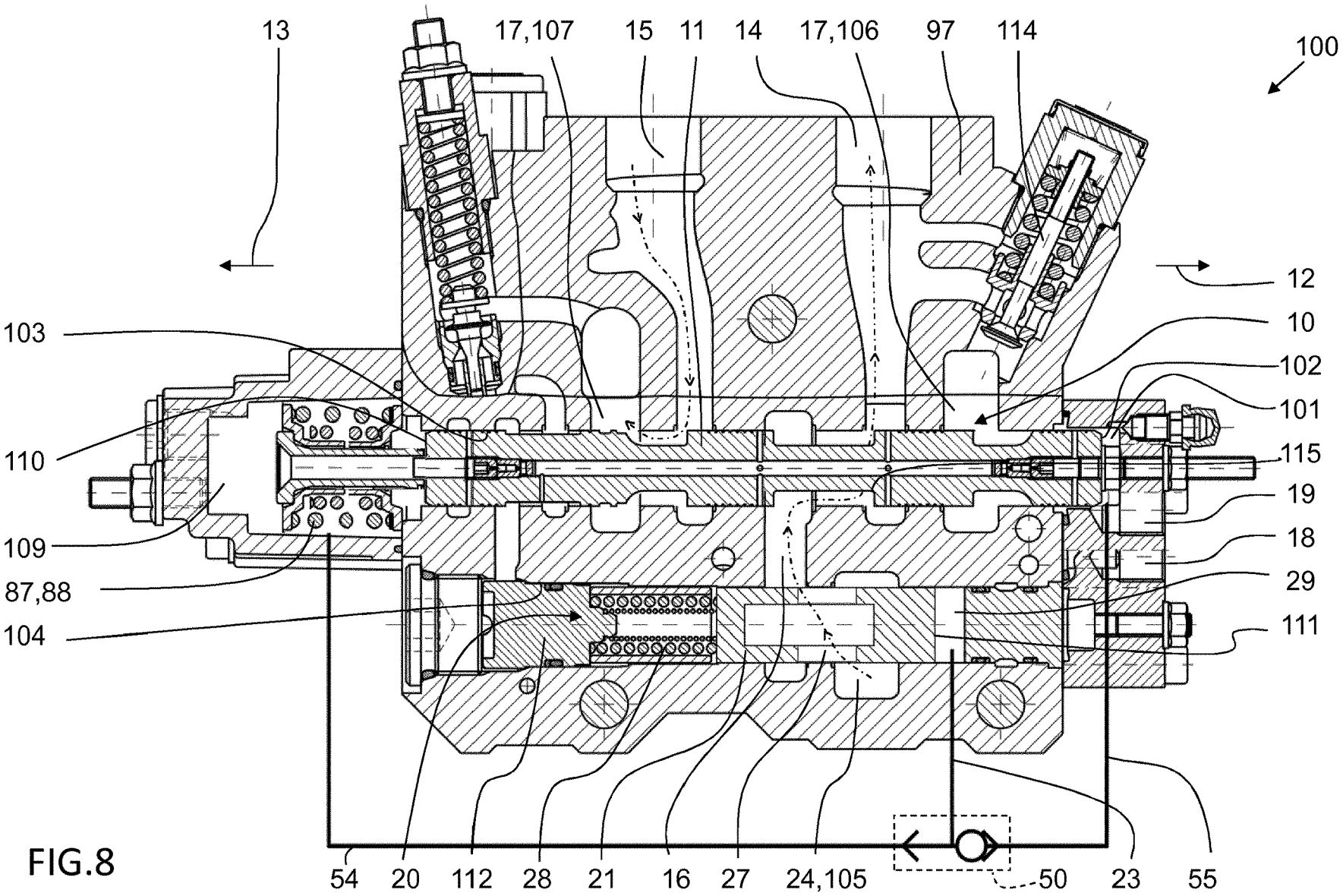
FIG. 8 shows the valve section in a first control state.

FIG. 7 shows the valve section 100 in a neutral operating position, FIG. 8 shows the valve section 100 with the first valve member 11 controlled to be displaced in the first axial direction 12, and FIG. 9 shows the valve section 100 with the first valve member 11 controlled to be displaced in the second axial direction 13.

Furthermore, the valve section 100 according to the example embodiment of FIG. 7-10 is configured such that the second pilot operated proportional control valve 20 is configured to operate as a meter-in valve that controls the flow of pressurized hydraulic fluid being supplied to the hydraulic actuator 60 and the first pilot operated proportional directional control valve 10 is configured to operate as a meter-out valve that controls the flow of hydraulic fluid being discharged from the hydraulic actuator 60.

The single valve section 100 depicted in FIG. 7 comprises the first and second valve members 11, 21, the first and second pilot pressure ports 18, 19 and a pilot pressure port 22 of the second pilot operated proportional control valve 20.

Moreover, the first and second valve members 11, 21 are spool valves that are axially slidably mounted in a first and second bore 103, 104, respectively, formed within a chassis 97 of the single valve section 100. The chassis 97 may be made in one-piece, as shown in FIG. 7.

The shuttle valve arrangement 50, and in particular the connections of the first and second shuttle inlet lines 54, 55 and the third pilot line 23 are merely schematically illustrated in FIG. 7.

Moreover, the shuttle valve arrangement 50 including the first and second shuttle inlet lines 54, 55 and the third pilot line 23 may be completely integrated within the valve section 100 for enabling a more compact design and less separate parts that must be fluidly connected.

The first pilot pressure port 18 is in fluid communication (fluid line not shown) with a corresponding first pilot control chamber 109 for enabling pilot pressure to exert an axial displacement force on a first axial surface 110 of the first valve member 11. Similarly, the second pilot pressure port 19 is in fluid communication with a corresponding second pilot control chamber 101 for enabling pilot pressure to exert an axial displacement force on a second axial surface 102 of the first valve member 11.

The first and second axial springs 87, 88 are here mounted on the same axial side of the first valve member 11 but with the same functionality, i.e. to locate the first valve member 11 in a neutral position when no pilot pressure is acting on the first valve member 11.

The second valve member 21 is configured to control a meter-in orifice defined by the second valve member 21 and the surround second bore 104, such that gradual axial displacement of the second valve member 20 in the second axial direction in FIG. 7 results in gradual opening of the meter-in orifice. The meter-in orifice may for example by provided by mean of an opening 27 or recess in the exterior surface of the second valve member 20 for enabling hydraulic fluid to pass from the inlet port 24 of the second pilot operated proportional control valve 20 to the fluid inlet port 16 of the first pilot operated proportional directional control valve 10.

A third spring element 28 exerts an axial force on the second valve member 21 towards a closed position, and pilot pressure supplied via a pilot pressure port (not showed) to a pilot control chamber 29 of the second pilot operated proportional control valve 20 via the third pilot line 23 is configured to exert an axial displacement force on an axial surface 111 of the second valve member 11 towards an open position.

An axial blocking member 112 provides axial support to the third spring element 28.

Moreover, in case the valve section is a conventional valve section having a main directional valve spool bore 103 for receiving a main valve for meter-control and routing control and a compensator valve spool bore 104 for receiving a pressure compensator valve, and wherein the first valve member according to the disclosure now is mounted in the main directional valve spool bore and the second valve member according to the disclosure now is mounted in the compensator valve spool bore, a hydraulic fluid load pressure passage is typically provided in the valve section for supplying load pressure to one side of the compensator valve spool bore. However, considering that this pressure compensating functionality now has been replaced individual meter-in and meter-out functionality, the hydraulic fluid load pressure passage is no longer necessary. Consequently, in FIG. 7, the axial blocking member 112 closes the hydraulic fluid load pressure passage configured for supplying load pressure to one side of the compensator valve spool bore.

In the example embodiment of the valve section shown in FIG. 7 a combined relief and anti-cavitation valve 114 also included, which serves to protect the hydraulic actuator and valve section from pressure spikes, and enables fluid flow from the tank 70, via fluid outlet port 17, to the first actuator port 14 in the event of underpressure in a chamber of the hydraulic actuator 60.

FIG. 7 shows the valve section 100 in a neutral operating position, with no pilot pressure acting on the first and second valve members 11, 21. Consequently, the first valve member 11 closes the flow path between the fluid inlet port 16 and the first actuator port 14 and the second actuator port 15. The first valve member 11 then also closes the flow path between the first and second actuator ports 14, 15 and the outlet port 17.

In addition, the third spring element 28 exerts an axial force on the second valve member 21 towards a closed position, such that no pressurized fluid is supplied to the fluid inlet port 16 of the he first pilot operated proportional directional control valve 10.

FIG. 8 shows the valve section 100 wherein the first valve member 11 has been controlled to be displaced in the first axial direction 12. This is performed by supplying hydraulic pilot pressure from the first proportional electro-hydraulic control valves 30 (not shown) to the first pilot pressure port 18, which is in fluid communication with the corresponding first pilot control chamber 109 for enabling pilot pressure to exert an axial displacement force on an axial surface 110 of the first valve member 11.

As a result of the displacement of the first valve member from a neutral position in the first axial direction 12 a first hydraulic fluid passage between the fluid inlet port 16 and the first actuator port 14 is opened, as well as a second hydraulic fluid passage between the second actuator port 15 and the outlet port.

Moreover, hydraulic pilot pressure from the first proportional electro-hydraulic control valves 30 (not shown) is also supplied to the shuttle valve arrangement 50 via the first shuttle inlet line 54 and further to the pilot control chamber 29 of the second pilot operated proportional control valve 20 via the third pilot line 23, such that hydraulic pilot pressure exerts an axial displacement force on the axial surface 111 of the second valve member 11 for displacing the second valve member 21 towards an open position.

The resulting hydraulic fluid flow is schematically illustrated in FIG. 8 with dash-dotted line, where pressurize fluid from enters at the fluid inlet 24, passes through the meter-in orifice defined by the second valve member 21 and second bore 104, passes further through a wide open hydraulic fluid flow passage that extends between the fluid inlet port 16 and a first actuator port 14 and controlled by the first valve member 11, and further to a the hydraulic actuator 60.

Fluid exiting the fluid actuator 60 is simultaneously supplied to the second actuator port 15 and passes through a meter-out orifice defined by a flow passage that extends between the second actuator port 15 and the outlet port 17, which meter-out orifice is controlled by the first valve member 11.

FIG. 8 only schematically shows the fluid flow and the sizes of the meter-in and meter-out orifices. Hence, in operation, the meter-in orifice defined by the second valve member 21 and second bore 104 is relatively small for enabling proper control of the meter-in flow, and the meter-out orifice is relatively small for enabling proper control of the meter-out flow. However, the hydraulic fluid flow passage that extends between the fluid inlet port 16 and a first actuator port 14, and thus past the first valve member 11 is configured to be relatively large for avoiding negative interference with the meter-in orifice defined by the second valve member 21 and second bore 104. In other words, the design of the transition 115 from small diameter to large diameter in the first valve member 11 in the passage that extends between the fluid inlet port 16 and a first actuator port 14 is arranged to provide a very large effective opening area immediately following a displacement of the first valve member 11 in the first direction 12, starting from the neutral position.

This configuration is further described with reference to FIG. 9, which schematically illustrates a diagram showing the effective opening areas of the passages controlled by the first valve member 11 upon displacement of the first valve member 11 in one direction. The diagram includes a first line 120 showing an example effective opening area A of the flow passage that extends between the fluid inlet port 16 and a first actuator port 14 and controlled by the first valve member 11, and a second line 121 showing an example effective opening area A of the meter-out orifice defined by a flow passage that extends between the second actuator port 15 and the outlet port 17 and which also is controlled by the first valve member 11.

The x-axis represents displacement D of the first valve member in the first axial direction 12, with start from the neutral position. The y-axis represents effective opening area A of each respective flow passage.

Lines 120 and 121 clearly shows that, very soon after initial displacement in the first axial direction, the effective opening area A of the flow passage that extends between the fluid inlet port 16 and a first actuator port 14 is configured to open both earlier and with a higher rate and thus to a higher end value compared with effective opening area A of the meter-out orifice defined by a flow passage that extends between the second actuator port 15 and the outlet port 17.

Hence, for any a given displacement D1 the effective opening area A1 of the flow passage that extends between the fluid inlet port 16 and a first actuator port 14 is at least two times, specifically at least 4 times, larger than the effective opening area A2 of the meter-out orifice defined by a flow passage that extends between the second actuator port 15 and the outlet port 17.

Meanwhile, the meter-in of the flow to the hydraulic actuator 60 is controlled by the meter-in orifice defined by the second valve member 21 and second bore 104.

Figure 10:
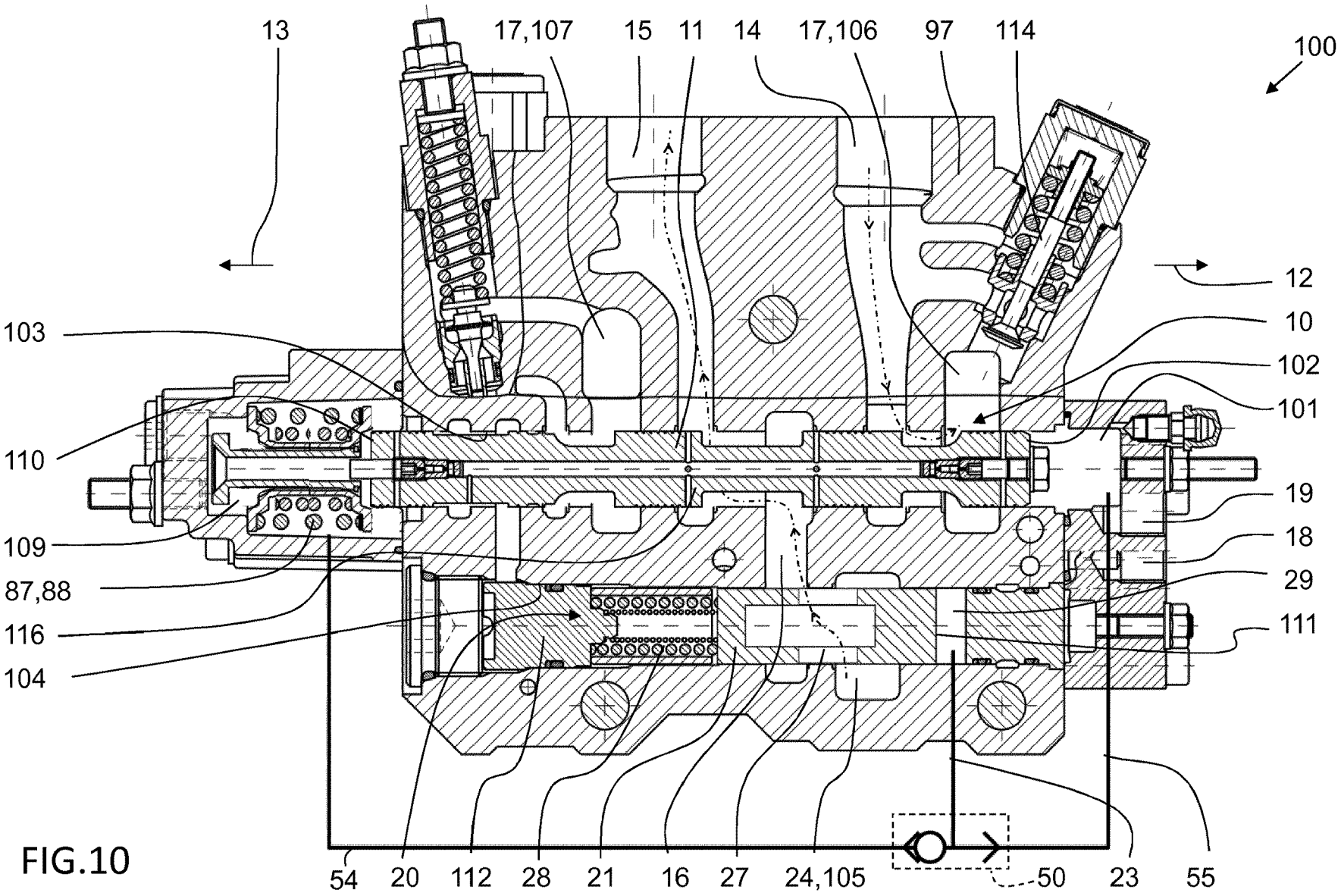
FIG. 10 shows the valve section in a second control state.

FIG. 10 shows the valve section in which the first valve member 11 has been controlled to be displaced in the second axial direction 13. This is performed by supplying hydraulic pilot pressure from the second proportional electro-hydraulic control valve 40 (not shown) to the second pilot pressure port 19, which is in fluid communication with the corresponding first pilot control chamber 101 for enabling pilot pressure to exert an axial displacement force on an axial surface 102 of the first valve member 11.

Displacement of the first valve member 11 in the second axial direction 13 opens a third hydraulic fluid passage between the fluid inlet port 16 and the second actuator port 15 and a fourth hydraulic fluid passage between the first actuator port 14 and the fluid outlet port 17.

Moreover, hydraulic pilot pressure from the second proportional electro-hydraulic control valves 40 (not shown) is also supplied to the shuttle valve arrangement 50 via the second shuttle inlet line 55 and further to the pilot control chamber 29 of the second pilot operated proportional control valve 20 via the third pilot line 23, such that hydraulic pilot pressure exerts an axial displacement force on the axial surface 111 of the second valve member 11 for displacing the second valve member 21 towards an open position.

The resulting hydraulic fluid flow is schematically illustrated in FIG. 10 with dash-dotted line, where pressurize fluid from enters at the fluid inlet 24, passes through the meter-in orifice defined by the second valve member 21 and second bore 104, passes further through a wide open hydraulic fluid flow passage that extends between the fluid inlet port 16 and the second actuator port 15 and controlled by the first valve member 11, and further to a the hydraulic actuator 60.

Fluid exiting the fluid actuator 60 is simultaneously supplied to the first actuator port 14 and passes through a meter-out orifice defined by a flow passage that extends between the first actuator port 14 and the outlet port 17, which meter-out orifice is controlled by the first valve member 11.

As above, FIG. 10 only schematically shows the fluid flow and the sizes of the meter-in and meter-out orifices. Hence, in operation, the meter-in orifice defined by the second valve member 21 and second bore 104 is relatively small for enabling proper control of the meter-in flow, and the meter-out orifice is relatively small for enabling proper control of the meter-out flow. However, the hydraulic fluid flow passage that extends between the fluid inlet port 16 and the second actuator port 15, and thus past the first valve member 11 is configured to be relatively large for avoiding negative interference with the meter-in orifice defined by the second valve member 21 and second bore 104. In other words, the design of the transition 116 from small diameter to large diameter in the first valve member 11 in the passage that extends between the fluid inlet port 16 and the second actuator port 15 is arranged to provide a very large effective opening area immediately following a displacement of the first valve member 11 in the second direction 13, starting from the neutral position.

Figure 11:
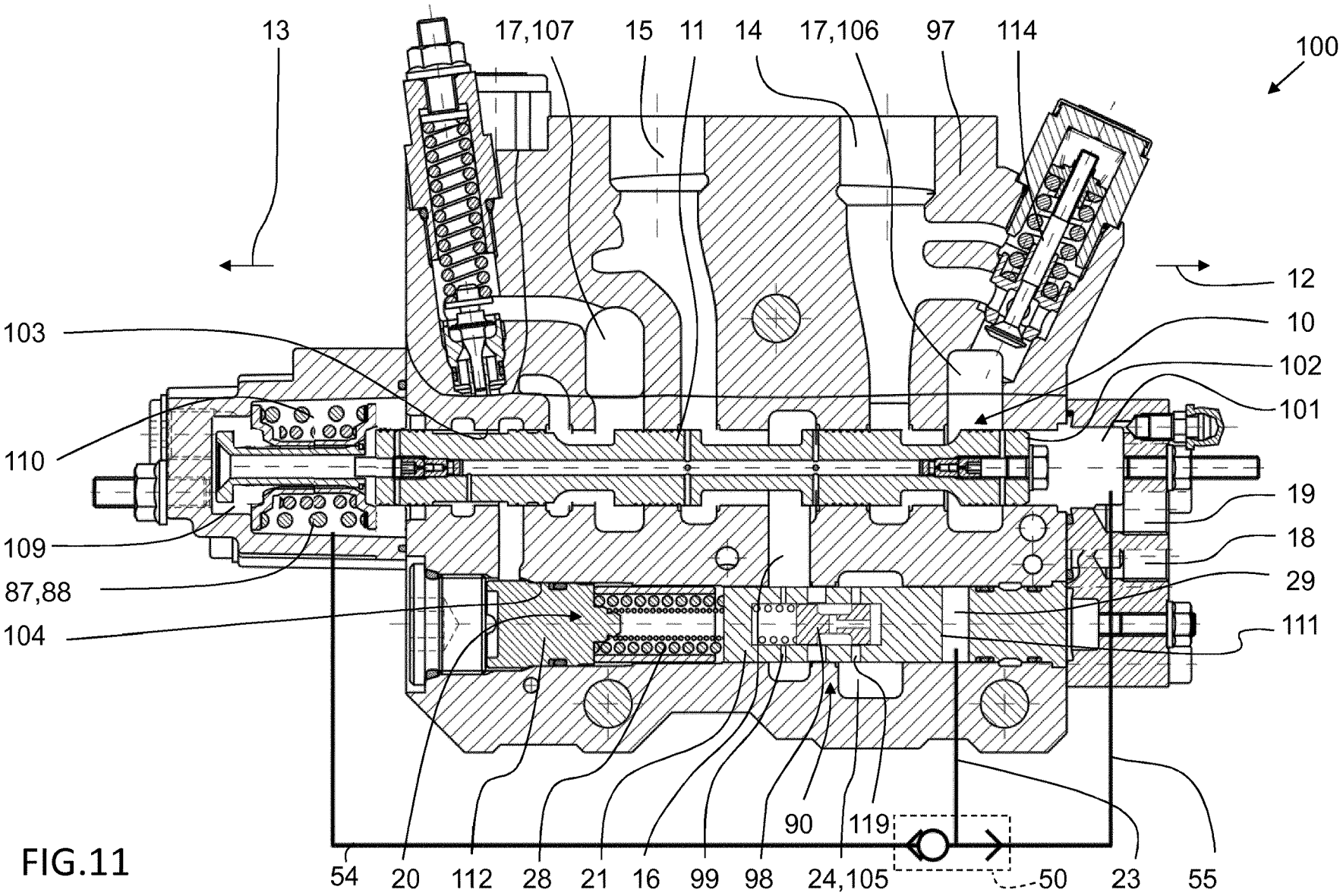
FIG. 11 shows a second example embodiment of a valve section according to the disclosure in a second control state.

FIG. 11 shows a further example embodiment of the valve section in an operating state corresponding to that shown in FIG. 10, but differing in that the pressure compensating valve 90 here is integrated within the single valve section 100.

In particular, according to the example embodiment of FIG. 11, the pressure compensating valve 90 is mounted within the second valve member 20 together with a bias spring 93 that acts on one side of the compensator spool 98.

The pressure compensating valve 90 comprises a load sensing via a load sensing port 99 and the bias spring 93 acts on the same side of the compensator spool, while pump pressure, supplied via a pump pressure port 119, acts on the opposite side of the spool 98. The working of the pressure compensating valve 90 is the same as descried above with reference to FIG. 3.

Figure 12:
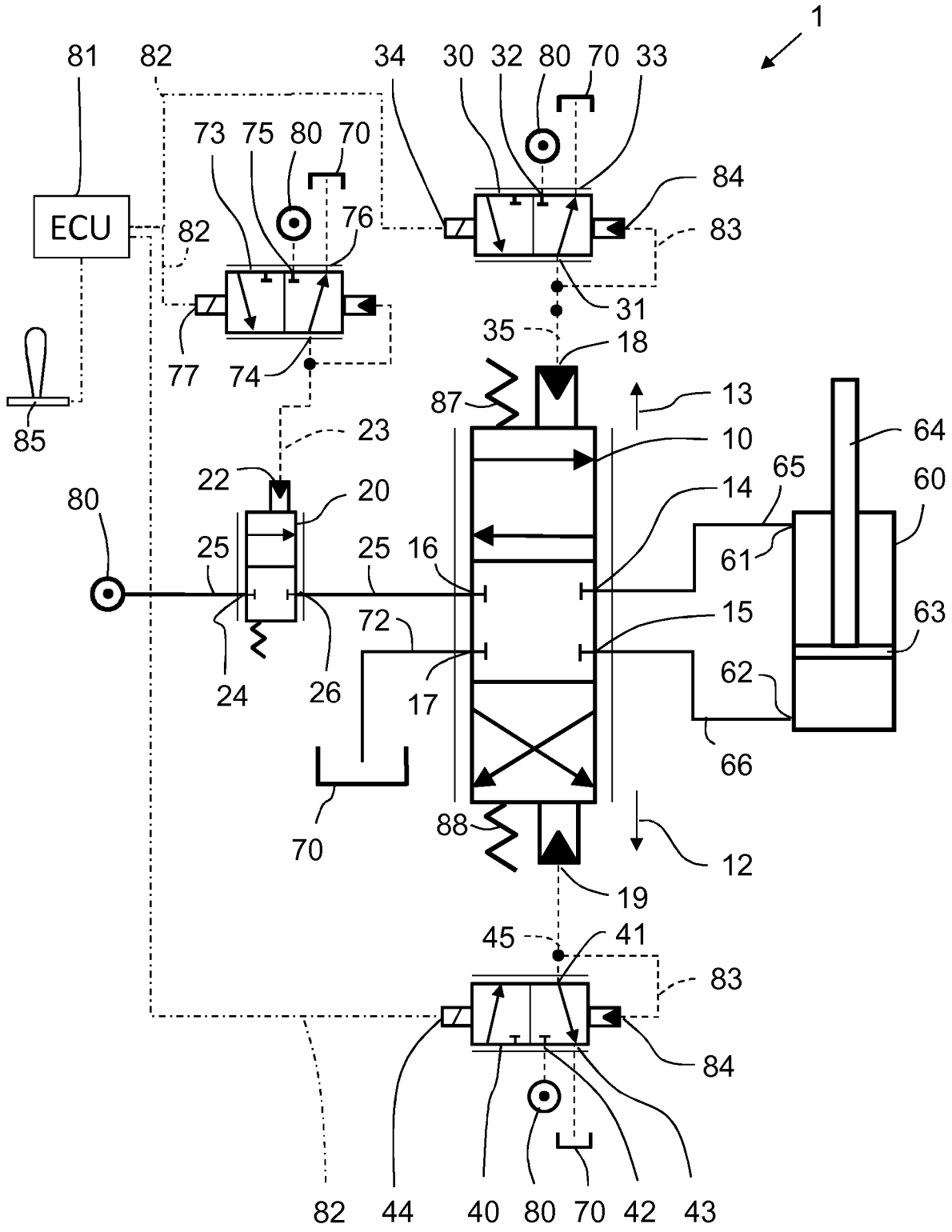
FIG. 12 shows a further example embodiment of the hydraulic valve arrangement.

Referring now to FIG. 12, there is depicted a further example embodiment of the hydraulic valve arrangement 1 enabling Individual meter-in and meter-out control of the hydraulic actuator 60 using only two valve members 10, 20 controlled by only three electro-hydraulic control valves 30, 40, 73, thereby providing a reasonably cost-effective and robust solution. Moreover, as described with reference to FIG. 1, the valve arrangement 1 is very similar in terms of design with a conventional valve section with integral directional control valve and compensator valve unit, such that the hydraulic valve arrangement 1 can be implemented using partly an existing valve section with reasonably amount of modification.

The hydraulic valve arrangement 1 illustrated in FIG. 12 differs only from the valve arrangement shown and described with reference to FIG. 1 in that the shuttle valve arrangement 50 used for controlling the second pilot operated proportional control valve 20 here is replaced with a third proportional electro-hydraulic control valve 73.

Consequently, the shuttle valve arrangement 50, including the first shuttle inlet line 54 connecting the outlet port 31 of the first proportional electro-hydraulic control valve 30 to the first inlet port 51 of the shuttle valve arrangement 50, and the second shuttle inlet line 55 connecting the outlet port 41 of the second proportional electro-hydraulic control valve 40 to the second inlet port 52 of the shuttle valve arrangement 50, are omitted and replaced by said third proportional electro-hydraulic control valve 73.

An outlet port 74 of the third proportional electro-hydraulic control valve 73 is fluidly connected to the pilot pressure port 22 of the second pilot operated proportional control valve 20 via a third pilot line 23.

The third proportional electro-hydraulic control valve 73 may have the same configuration and design as any of the first and second proportional electro-hydraulic control valves 30, 40, and reference is made to the description above for details. Specifically, the third proportional electro-hydraulic control valve 73 has fluid inlet port 75 connected to a pressurized fluid source 80, a discharge port 76 fluidly connected to a tank 70, and an electrical control signal port 77 for receiving electrical control signals from an electronic control unit (ECU) 81, either via an electrical wire 82, or wirelessly.

In the hydraulic valve arrangement according to FIG. 12, individual meter-in and meter-out control of the hydraulic actuator 60 is providable by having the second pilot operated proportional control valve 20 configured to operate as a meter-in valve of the hydraulic actuator 60 and the first pilot operated proportional directional control valve 10 configured to operate as a meter-out valve of the hydraulic actuator 60.

However, contrary to the embodiment of FIG. 1, in which the meter-in orifice in the second pilot operated proportional control valve 20 is proportional to the supplied hydraulic pilot pressure from any of the first and second proportional electro-hydraulic control valves 30, 40, in the example embodiment of FIG. 12, the meter-in orifice in the second pilot operated proportional control valve 20 is proportional to the supplied hydraulic pilot pressure from the third proportional electro-hydraulic control valve 73. In other words, the first and second proportional electro-hydraulic control valves 30, 40 take the role as meter-out controlling valves while the third proportional electro-hydraulic control valve 73 take the role as meter-in controlling valve.

Thereby, the previously described dual-functionality of first and second proportional electro-hydraulic control valves 30, 40, wherein both said valves 30, 40 act as meter-in and meter-out controlling valves, depending on the operating state of the first pilot operated proportional directional control valve 10, is omitted. Consequently, the hydraulic valve arrangement according to the example embodiment of FIG. 12 may be implemented using less complex control software in the ECU 81.

To conclude, the hydraulic valve arrangement according to the example embodiment of FIG. 12 comprises: a first pilot operated proportional directional control valve 10 having a first valve member 11 that is displaceable in a first and a second axial direction 12, 13 for controlling direction of supply and discharge of hydraulic fluid to and from a hydraulic actuator 60, a first proportional electro-hydraulic control valve 30 for controlling displacement of the first valve member 11 in the first axial direction 12, a second proportional electro-hydraulic control valve 40 for controlling displacement of the first valve member 11 in the second axial direction 13, a second pilot operated proportional control valve 20 having a second valve member 21 configured to be controlled by a third proportional electro-hydraulic control valve 73, wherein individual meter-in and meter-out control of the hydraulic actuator 60 is providable by having: the second pilot operated proportional control valve 20 configured to operate as a meter-in valve of the hydraulic actuator 60 and the first pilot operated proportional directional control valve 10 configured to operate as a meter-out valve of the hydraulic actuator 60, or the first pilot operated proportional directional control valve 10 configured to operate as a meter-in valve of the hydraulic actuator 60 and the second pilot operated proportional control valve 20 configured to operate as a meter-out valve of the hydraulic actuator 60.

The alternative design of the hydraulic valve arrangement described with reference to FIG. 12 may of course also be implemented in the embodiments described with reference to FIGS. 1-8 and 10-11.

The disclosure also concerns a vehicle, such as in particular a working vehicle, comprising a hydraulic actuator 60 and a hydraulic valve arrangement 1 as described above for controlling the motion of the hydraulic actuator 60.

Although the disclosure has been described in relation to specific combinations of components, it should be readily appreciated that the components may be combined in other configurations as well which is clear for the skilled person when studying the present application. Thus, the above description of the example embodiments of the present disclosure and the accompanying drawings are to be regarded as a non-limiting example of the disclosure and the scope of protection is defined by the appended claims. Moreover, the hydraulic valve arrangement according to the disclosure has been described in details with reference to FIGS. 1-12 but these embodiments merely describe some example configurations, and the valve arrangement can have other alternative designs without leaving the scope of the claims below. For example, even if the first pilot operated control valve 10 has been primarily described as a closed centre double acting directional control valve having a spool type D or spool type R (regenerative spool), many other valve and spool configurations are possible within the scope of the disclosure, such as for example open centre valve or spool type Dm, Da, Db, S, M, F, DQ. Similarly, even if the second directional control valve 20 has been primarily described as single acting 2/2 directional control valve, many other valve and spool configurations are possible within the scope of the disclosure, such as for example double acting valve or spool type Dm, Da, Db, S, M, F, DQ. Moreover, any reference sign in the claims should not be construed as limiting the scope.

The term "coupled" is defined as connected, although not necessarily directly, and not necessarily mechanically.

The use of the word "a" or "an" in the specification may mean "one," but it is also consistent with the meaning of "one or more" or "at least one." The term "about" means, in general, the stated value plus or minus 10%, or more specifically plus or minus 5%. The use of the term "or" in the claims is used to mean "and/or" unless explicitly indicated to refer to alternatives only.

The terms "comprise", "comprises" "comprising", "have", "has", "having", "include", "includes", "including" are open-ended linking verbs. As a result, a method or device that "comprises", "has" or "includes" for example one or more steps or elements, possesses those one or more steps or elements, but is not limited to possessing only those one or more elements.

The term "fluidly connected" herein means that hydraulic fluid may be conveyed between two fluidly connected members.

The invention claimed is:

1. A hydraulic valve arrangement comprising, a first pilot operated proportional directional control valve having a first valve member that is displaceable in a first and a second axial direction for controlling direction of supply and discharge of hydraulic fluid to and from a hydraulic actuator, a first proportional electro-hydraulic control valve for controlling displacement of the first valve member in the first axial direction, a second proportional electro-hydraulic control valve for controlling displacement of the first valve member in the second axial direction, and a second pilot operated proportional control valve having a second valve member configured to be controlled by the first and second proportional electro-hydraulic control valves via a shuttle valve arrangement, wherein individual meter-in and meter-out control of the hydraulic actuator is providable by having:

the second pilot operated proportional control valve configured to operate as a meter-in valve of the hydraulic actuator and the first pilot operated proportional directional control valve configured to operate as a meter-out valve of the hydraulic actuator, or the first pilot operated proportional directional control valve configured to operate as a meter-in valve of the hydraulic actuator and the second pilot operated proportional control valve configured to operate as a meter-out valve of the hydraulic actuator.

2. The hydraulic valve arrangement according to claim 1, wherein when the first pilot operated proportional directional control valve operates as a meter-in valve of the hydraulic actuator, a hydraulic fluid flow passage, extending between a first or a second actuator port and a fluid outlet port of the first pilot operated proportional directional control valve and controlled by the first valve member, is wide open, and when the first pilot operated proportional directional control valve operates as a meter-out valve of the hydraulic actuator, a hydraulic fluid flow passage, extending between a fluid inlet port and the first or the second actuator port of the first pilot operated proportional directional control valve and controlled by the first valve member, is wide open.

3. The hydraulic valve arrangement according to claim 1, wherein the shuttle valve arrangement has a first and second inlet port and an outlet port, wherein the outlet port of the first proportional electro-hydraulic control valve is fluidly connected to the first inlet port of the shuttle valve arrangement, wherein the outlet port of the second proportional electro-hydraulic control valve is fluidly connected to the second inlet port of the shuttle valve arrangement, and the outlet port of the shuttle valve arrangement is fluidly connected to the pilot pressure port of the second pilot operated proportional control valve.

4. The hydraulic valve arrangement according to claim 1, wherein a flow control position of the second valve member is controlled by the control valve, out of the first and second proportional electro-hydraulic control valves, which outputs the highest pilot pressure to the shuttle valve arrangement, and wherein a flow control position of the first valve member is controlled by the combined pilot pressure from both the first and second proportional electro-hydraulic control valves acting on opposite ends of the first valve member.

5. The hydraulic valve arrangement according to claim 1, wherein the first or the second proportional electro-hydraulic control valve, one at a time, is arranged to exert a displacement force on both the first and second valve members.

6. The hydraulic valve arrangement according to claim 1, further comprising an electronic controller for providing electrical control signals to the first and second proportional electro-hydraulic control valves, wherein the electronic controller is configured to provide simultaneous output of control signals to both the first and second proportional electro-hydraulic control valves for enabling individual simultaneous meter-in and meter-out control of the supply and discharge of hydraulic fluid to and from a hydraulic actuator.

7. The hydraulic valve arrangement according to claim 1, wherein the first pilot operated proportional directional control valve has an inlet port for receiving pressurized hydraulic fluid, a first and a second actuator port for supply and discharge of hydraulic fluid to and from the hydraulic actuator, an outlet port for discharging hydraulic fluid to a tank, a first and a second pilot pressure port, and wherein the first valve member is displaceable from a neutral position in the first and a second axial direction by by means of pilot pressure acting on the first valve member.

8. The hydraulic valve arrangement according to claim 7, wherein the first proportional electro-hydraulic control valve has an outlet port fluidly connected to the first pilot pressure port of the first pilot operated proportional directional control valve for controlling displacement of the first valve member in the first axial direction, and wherein the second proportional electro-hydraulic control valve has an outlet port fluidly connected to the second pilot pressure port the first pilot operated proportional directional control valve for controlling displacement of the first valve member in the second axial direction.

9. The hydraulic valve arrangement according to claim 1, wherein displacement of the first valve member in the first axial direction opens a first hydraulic fluid passage between a fluid inlet port and a first actuator port, and a second hydraulic fluid passage between a second actuator port and an outlet port, and wherein displacement of the first valve member in the second axial direction opens a third hydraulic fluid passage between the fluid inlet port and the second actuator port and a fourth hydraulic fluid passage between the first actuator port and the fluid outlet port.

10. The hydraulic valve arrangement according to claim 1, wherein the second pilot operated proportional control valve has an inlet port, an outlet port and a pilot pressure port, wherein the second valve member is arranged to control the flow of hydraulic fluid through the second pilot operated control valve, and wherein the inlet port of the second pilot operated proportional control valve is fluidly connected, directly or indirectly, to a source of pressurized hydraulic fluid, and the outlet port of the second pilot operated proportional control valve is fluidly connected, directly or indirectly, to an inlet port of the first pilot operated proportional directional control valve, or the inlet port of the second pilot operated proportional control valve is fluidly connected, directly or indirectly, to an outlet port of the first pilot operated proportional directional control valve, and the outlet port of the second pilot operated proportional control valve fluidly connected, directly or indirectly, to the tank.

11. The hydraulic valve arrangement according to claim 1, wherein a pressure compensating valve is provided in the hydraulic fluid supply that fluidly connects a source of pressurized hydraulic fluid with an inlet port of the first pilot operated proportional directional control valve, and when the second pilot operated proportional control valve configured to operate as a meter-in valve of the hydraulic actuator the pressure compensating valve is provided either upstream or downstream of the second pilot operated proportional control valve.

12. The hydraulic valve arrangement according to claim 1, wherein both the first pilot operated proportional directional control valve and the second pilot operated proportional control valve are provided in a single valve section, which comprises a chassis made in one piece and is configured to be stacked and clamped together with other valve sections for forming a complete valve unit.

13. The hydraulic valve arrangement according to claim 12, wherein the single valve section comprises the first and second valve member, the first and second pilot pressure ports and a pilot pressure port of the second pilot operated proportional control valve.

14. The hydraulic valve arrangement according to claim 12, wherein the first and second valve members are spool valves, each mounted in an individual bore of the single valve section.

15. The hydraulic valve arrangement according to claim 12, wherein the single valve section further comprises a pressure compensating valve.

16. The hydraulic valve arrangement according to claim 12, wherein a pressure compensating valve is mounted within the second valve member.

17. The hydraulic valve arrangement according to claim 12, wherein the single valve section is conventional valve section having a main directional valve spool bore and a compensator valve spool bore, wherein the first valve member is mounted in the main directional valve spool bore and the second valve member is mounted in the compensator valve spool bore.

18. A Vehicle comprising a hydraulic actuator and a hydraulic valve arrangement according to claim 1 for controlling the motion of the hydraulic actuator.

* * * * *